US007813665B2

(12) United States Patent
Fujiwara et al.

(10) Patent No.: US 7,813,665 B2
(45) Date of Patent: Oct. 12, 2010

(54) IMAGE FORMING APPARATUS AND FIXING DEVICE

(75) Inventors: Yasushi Fujiwara, Nagoya (JP); Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 670 days.

(21) Appl. No.: 11/482,107

(22) Filed: Jul. 7, 2006

(65) Prior Publication Data

US 2007/0053712 A1 Mar. 8, 2007

(30) Foreign Application Priority Data

Jul. 8, 2005 (JP) ..... 2005-199902

(51) Int. Cl.
*G03G 15/00* (2006.01)

(52) U.S. Cl. ..... 399/90; 399/88; 399/37

(58) Field of Classification Search ..... 399/90, 399/122, 37, 88, 411
See application file for complete search history.

(56) References Cited

U.S. PATENT DOCUMENTS 4,791,448 A * 12/1988 Kawashima et al. ..... 399/122
5,528,345 A 6/1996 Hasegawa
5,579,098 A * 11/1996 Noguchi et al. ..... 399/122
5,737,664 A 4/1998 Fukuda et al.
5,826,141 A * 10/1998 Mitsuya ..... 399/122
2004/0028424 A1* 2/2004 Yokoi ..... 399/90
2004/0105695 A1* 6/2004 Seo ..... 399/90
2005/0019053 A1* 1/2005 Ise ..... 399/90
2005/0025516 A1* 2/2005 Kinouchi et al. ..... 399/90
2006/0013611 A1* 1/2006 Ise ..... 399/90
2006/0140675 A1* 6/2006 Kim et al. ..... 399/122

FOREIGN PATENT DOCUMENTS

JP 8-6416 1/1996
JP 8-63038 3/1996
JP 9-204085 8/1997
JP 10-319756 12/1998
JP 11-133774 5/1999
JP 2002-258715 9/2002

* cited by examiner

*Primary Examiner*—David M Gray
*Assistant Examiner*—Rodney Bonnette
(74) *Attorney, Agent, or Firm*—Banner & Witcoff, Ltd.

(57) ABSTRACT

A fixing unit mounting section is formed to a main body frame. A fixing unit is mounted to the fixing unit mounting section by inserting the fixing unit into the main body along a predetermined inserting direction. An electric power supply section configured to supply electric power to the fixing unit is arranged at a near side of the fixing unit mounting section in the inserting direction. A connecting section configured to establish electric connection to the electric power supply section is formed at the near side of the fixing unit in the inserting direction.

52 Claims, 9 Drawing Sheets

IMAGE FORMING APPARATUS AND FIXING DEVICE

BACKGROUND OF THE INVENTION

1. Field of the Invention

The present invention relates to an image forming apparatus that is configured to fix an image by a developer onto a sheet-like recording medium to thereby form an image onto the recording medium. Further, the present invention relates to a fixing device that is mounted to a main body of the above-mentioned image forming apparatus and configured to fix the image by the developer onto the recording medium.

2. Description of the Related Art

This type of the image forming apparatus accommodates the fixing device, which is made into a unit, in a main body case of the image forming apparatus. This fixing device has a heat roller and a pressure roller (facing roller) arranged so as to face the heat roller. The one disclosed in the Japanese Patent Application Laid-Open (kokai) No. 08-6414 has been known as the configuration of the image forming apparatus and fixing device described above.

In the fixing device described above, the bearing sections of both the left and right edges of the cylindrical heat roller and pressure roller are supported by support side plates provided at the left and right of the lower case. Notably, the "left and right" directions here mean the widthwise direction of a sheet that is vertical to the sheet transporting direction and thickness direction of the sheet. A pair of left and right holders made of metallic spring plate is fixed to the lower face of the top plate of the upper case that covers the heat roller. These holders are arranged at the left and right edge sections of the upper case.

Connection sections are respectively formed at the lower edges of the pair of left and right holders. The above-mentioned holders are configured such that the connection sections support electrode terminals formed at both left and right sides of a bar-like heater inserted in the heat roller and electric power is supplied to these electrode terminals.

The aforesaid pair of left and right holders is fixed to the top plate of the upper case by screws. The screws constitute an electric power supply section for supplying electric power to the holders and electrode terminals. This electric power supply section is connected to a power circuit provided to a control substrate via a wiring.

Also, Those disclosed in the following patent documents are known as a device structure for supplying electric power to the fixing device in the image forming apparatus; Japanese Patent Application Laid-Open (kokai) No. 08-6416, Japanese Patent Application Laid-Open (kokai) No. 08-63038, Japanese Patent Application Laid-Open (kokai) No. 10-319756, Japanese Patent Application Laid-Open (kokai) No. 11-133774, Japanese Patent Application Laid-Open (kokai) No. 2002-258715.

In manufacturing this type of the image forming apparatus, the fixing device is mounted to the main body section of the image forming apparatus. During this mounting process, it is necessary to establish an electrical connection between the main body section of the image forming apparatus and the fixing device. The operation for establishing the electrical connection has conventionally been very troublesome.

Accordingly, it is an important subject to provide a configuration of an image forming apparatus and a fixing device in which an operation for establishing an electrical connection for supplying electric power to the fixing device can easily and surely be carried out during the process for mounting the fixing device to the main body section of the image forming apparatus.

SUMMARY OF THE INVENTION (1) An image forming apparatus according to the present invention has a fixing unit configured to fix an image by a developer attached to a recording medium onto the recording medium; and a main body section to which the fixing unit is mounted.

(1-1) The feature of the present invention is such that the aforesaid image forming apparatus is configured as follows.

In the image forming apparatus according to the present invention, a fixing unit mounting section to which the fixing unit is mounted by insertion of the fixing unit along a predetermined inserting direction is formed to the main body section. An electric power supply section configured to supply electric power to the fixing unit is arranged at the near side of the fixing unit mounting section in the inserting direction. Further, a connection section configured to establish an electrical connection to the electric power supply section is formed at a near side of the fixing unit in the inserting direction.

Upon assembling the image forming apparatus of the present invention thus configured, the fixing unit is inserted to the main body section along the aforesaid predetermined inserting direction, so that the fixing unit is mounted to the fixing unit mounting section. The electric power supply section for supplying electric power to the fixing unit is arranged at the near side of the fixing unit mounting section in the inserting direction. Further, the connection section for establishing an electrical connection to the electric power supply section is formed at the near side of the fixing unit in the inserting direction. Therefore, when performing the operation for establishing the electrical connection in order to supply electric power to the fixing unit, the electrical connection between the electric power supply section and the connection section can be established from the near side in the inserting direction after the fixing unit is mounted to the fixing unit mounting section.

As described above, according to the image forming apparatus of the present invention, the operation for establishing the electrical connection can be performed from the near side in the inserting direction in which the fixing unit is inserted to the main body section of the image forming apparatus. Accordingly, the operation for establishing the electrical connection can be easily and surely carried out. Further, the confirmation of whether the operation for establishing the electrical connection is surely carried out can be facilitated by the visual confirmation from the near side, for example.

In the case where the fixing unit is detached from or attached to the main body section for maintenance of the image forming apparatus, the operation for releasing or establishing the electrical connection is required. According to the present invention, these operations can readily and surely be carried out in these cases.

(1-2) In the image forming apparatus having the configuration disclosed in the aforesaid (1-1), the connection section may be collectively formed at one end of the fixing unit in a direction perpendicular to the inserting direction, and the electric power supply section may be formed at a position facing the connection section.

According to this configuration, when performing the aforesaid operation for establishing the electrical connection, the electrical connection between the electric power supply section and the connection section is readily established, since the electric power supply section and the connection section are collectively formed at one end of the fixing unit.

Moreover, in the case where the electric power supply section has a connector fitted to the connection section and a wiring section connected to this connector, the wiring section bridged between the fixing unit and the main body section is collected (at one end portion of the fixing unit). Therefore, the fixing unit can easily be detached from the main body section with the electrical connection between the electric power supply section and the connection section maintained, in the case of the maintenance of the image forming apparatus, for example.

(1-3) In the image forming apparatus having the aforesaid configuration disclosed in the above-mentioned (1-1) and (1-2), the fixing unit insertion opening section into which the fixing unit is inserted for mounting the fixing unit to the fixing unit mounting section is formed at the main body section, the fixing unit mounting section is composed of a portion at a front side of the inserting direction in an inner space of the fixing unit insertion opening section, and the electric power supply section is arranged at a position proximate to the connection section.

Upon assembling the image forming apparatus thus configured of the present invention, the fixing unit is inserted along the inserting direction into the fixing unit insertion opening section formed at the main body section. Then, the fixing unit is mounted to the fixing unit mounting section formed in the inner space of the fixing unit mounting section at the front side of the inserting direction (the destination of insertion of the fixing unit). At this time, the electric power supply section for supplying electric power to the fixing unit is arranged at the near side of the fixing unit mounting section in the inserting direction. Further, the electric power supply section is arranged at the position proximate to the connection section. Specifically, the electric power supply section is formed, for example, at the position inside the fixing unit insertion opening section at the main body section and corresponding to the connection section at the fixing unit.

According to this configuration, the electrical connection between the electric power supply section and the connection section can more readily and surely be performed. The same is true for the operation for establishing or releasing the electrical connection for the maintenance of the image forming apparatus described above.

(1-4) In the image forming apparatus having the configuration disclosed in the aforesaid (1-3), the fixing unit insertion opening section may be formed to be open toward a transporting direction of the recording medium, and the connection section may be formed to be exposed toward the transporting direction from the fixing unit.

In this configuration, the fixing unit is inserted into the fixing unit insertion opening of the main body section along the inserting direction that is opposite to the transporting direction, whereby the fixing unit is mounted to the fixing unit mounting section. Further, the fixing unit insertion opening is open so as to expose the fixing unit to the outside toward the transporting direction with the fixing unit mounted to the fixing unit mounting section.

Accordingly, the workability upon mounting the fixing unit to the main body section and upon establishing the electrical connection, and the maintenance property of the image forming apparatus can further be enhanced.

(1-5) In the image forming apparatus having the configuration disclosed in the aforesaid (1-1) to (1-4), the fixing unit has a heat roller, a facing roller, a fixing unit case, and a facing roller support member, wherein the connection section may be formed to the fixing unit case so as to supply electric power to the heater.

The heat roller is formed into a hollow cylindrical shape, and is configured to accommodate a heater that generates heat for heating the developer. This heat roller is arranged along the widthwise direction of the recording medium that is perpendicular to the transporting direction and the thickness direction of the recording medium.

Further, the facing roller is arranged along the widthwise direction of the recording medium so as to face the heat roller. This facing roller is configured to rotate as nipping the recording medium with the heat roller to thereby be capable of sending the recording medium in the transporting direction.

The fixing unit case is configured to rotatably support both end portions of the heat roller in the widthwise direction and to cover the heat roller.

The facing roller support member is configured to rotatably support both end portions of the facing roller in the widthwise direction. It is supported at both end portions of the fixing unit case in the widthwise direction.

In this configuration, upon mounting the fixing unit to the main body section, the fixing unit is inserted to the main body section along the aforesaid inserting direction, so that the fixing unit is mounted to the fixing unit mounting section. At this time, the electric power supply section for supplying electric power to the fixing unit is arranged at the near side of the fixing unit mounting section in the inserting direction. Further, the connection section for establishing an electrical connection to the electric power supply section is formed at the near side of the fixing unit in the inserting direction. Therefore, the electrical connection between the electric power supply section at the main body section and the connection section formed at the near side of the fixing unit case in the inserting direction can be established from the near side in the inserting direction.

Accordingly, the electrical connection between the fixing unit and the main body section for supplying electric power to the heater can more simply and surely be carried out.

(1-6) In the image forming apparatus having the configuration disclosed in the aforesaid (1-5), the fixing unit case and the facing roller support member may be configured to expose the facing roller to the outside of the fixing unit.

According to this configuration, the maintenance property of the image forming apparatus is further enhanced.

According to this configuration, the cover member for covering the facing roller is omitted, so that the outer dimension of the fixing unit is reduced. Therefore, the fixing unit mounting section at the main body section can also be reduced. Accordingly, further miniaturization of the image forming apparatus can be achieved.

(1-7) In the image forming apparatus having the configuration disclosed in the aforesaid (1-5) and (1-6), a drive gear configured to transmit rotational drive force from the main body section may be mounted to the end portion of the heat roller or the facing roller in the widthwise direction, and the connection section may be formed at the end portion of the fixing unit case in the widthwise direction that is opposite to a side where the drive gear is arranged.

According to this configuration, the drive gear is arranged at one end portion of the fixing unit case in the widthwise direction. Further, the connection section is arranged at the other end portion (the end portion where the drive gear is not arranged) of the fixing unit case in the widthwise direction.

Therefore, the electrical connection to the electric power supply section is established at the end portion of the fixing unit where the drive gear is not arranged. Accordingly, the workability of the electrical connection is further enhanced.

(1-8) The image forming apparatus having the configuration disclosed in the aforesaid (1-5) to (1-7) further has a conductive member configured to electrically connect the heater with the connection section, wherein the conductive member may be arranged in the fixing unit case along a surface facing the heat roller.

According to this configuration, the conductive member is arranged inside the fixing unit case without exposing to the outside of the fixing unit case. Moreover, the conductive member is arranged inside the fixing unit case so as not to be in contact with the heat roller. Consequently, the reliability in the operations of the image forming apparatus and the fixing unit is enhanced.

(1-9) In the image forming apparatus having the configuration disclosed in the aforesaid (1-8), the conductive member may be made of a metallic member that is not covered by a cylindrical insulating coating member. Specifically, the conductive member is arranged along the surface facing the heat roller with the "bare" state that means it is not covered by an insulating coating member made of a synthetic resin used for a wiring cord or insulating sleeve of the wire.

According to this configuration, It is unnecessary to coat the conductive member upon fabricating the image forming apparatus. Therefore, the production cost of the image forming apparatus and the fixing unit relating to the conductive member can be reduced. Notably, the conductive member may be the one in which a thin-film coating (e.g., such as a skin layer of an enameled wire) is formed beforehand on its surface.

(1-10) In the image forming apparatus having the configuration disclosed in the aforesaid (1-8) and (1-9), the conductive member may be composed of a plate-like member and a linear member connected to the plate-like member. Specifically, the plate-like member and the linear member are arranged on the surface of the fixing unit case facing the heat roller.

According to this configuration, it can be inhibited that the surface of the conductive member is made close to the surface of the heat roller due to the heat deformation caused by the radiant heat from the heat roller, compared to the case where the whole conductive member is composed of the plate-like member. Therefore, the reliability of the operations of the image forming apparatus and the fixing unit is enhanced.

(1-11) The image forming apparatus having the configuration disclosed in the aforesaid (1-1) to (1-10) may have a connection section cover for covering the connection section.

In this configuration, the connection section (and the electric power supply section) can be covered so as not to be exposed to the outside.

(1-12) In the image forming apparatus having the configuration disclosed in the aforesaid (1-11), the connection section cover may be arranged at the near side in the inserting direction.

According to this configuration, the connection section cover can easily be attached and detached.

(1-13) In the image forming apparatus having the configuration disclosed in the aforesaid (1-1) to (1-12), the main body section may have an open/close cover that can be opened or closed along the inserting direction, and the electric power supply section may be arranged at the open/close cover.

According to this configuration, the electrical connection between the connection section and the electric power supply section is performed in synchronism with the opening and closing of the open/close cover provided with the electric power supply section. In particular, opening the open/close cover can release the electrical connection for supplying electric power to the fixing unit with the fixing unit exposed to the outside.

(1-14) In the image forming apparatus having the configuration disclosed in the aforesaid (1-1) to (1-13), the electric power supply section may have a connector configured to be fitted to the connection section and a wiring section connected to the connector, and the main body section may have a guide member configured to guide the wiring section.

When performing the electrical connection for supplying electric power to the fixing unit during the assembly of the image forming apparatus of the present invention having the aforesaid configuration, the fixing unit is mounted to the fixing unit mounting section of the main body section, and then, the connector and the connection section are fitted to each other from the near side in the inserting direction, whereby the electrical connection between the electric power supply section and the connection section is established. The wiring section connected to the connector is guided by the guide member formed at the main body section. Accordingly, this inhibits the wiring section from being caught at the movable section in the image forming apparatus.

(1-15) In the image forming apparatus having the configuration disclosed in the aforesaid (1-14), the main body section may have a pair of side frames arranged along the widthwise direction of the recording medium so as to support the fixing unit, and the guide member may be arranged at the side frames.

(2) The fixing device of the present invention corresponds to the fixing unit in the configuration of the aforesaid (1-1) to (1-14).

Particularly, the fixing device of the present invention is preferably configured as follows.

(2-1) The fixing device that is the subject of the present invention has a heat roller, facing roller, and fixing unit case.

The heat roller is formed into a hollow cylindrical shape, and is configured to accommodate a heater for generating heat that is for heating the developer. This heat roller is arranged along the widthwise direction of the recording medium that is perpendicular to the transporting direction and thickness direction of the recording medium.

The facing roller is arranged along the widthwise direction of the recording medium so as to face the heat roller. This facing roller is configured to rotate as nipping the recording medium with the heat roller to thereby be capable of sending the recording medium in the transporting direction.

The fixing unit case is configured to rotatably support both end portions of the heat roller in the widthwise direction and to cover the heat roller.

The feature of the present invention is such that the fixing device is configured as follows.

The fixing device has a facing roller support member that is supported at both end portions of the fixing unit case in the widthwise direction and rotatably supports both end portions of the facing roller in the widthwise direction. The connection section configured to be electrically connected to the electric power supply section that extends from the main body section for supplying electric power to the heater is formed at the near side of the fixing unit case in the inserting direction.

When mounting the fixing device of the present invention having the aforesaid configuration to the main body section of the image forming apparatus, the fixing device is inserted to the main body section along the predetermined inserting direction, so that the fixing device is mounted to a fixing device mounting section that is the section for mounting the fixing device. At this time, the electric power supply section for supplying electric power to the heater provided to the fixing device is arranged at the near side of the fixing device mounting section in the inserting direction. Further, the connection section for establishing an electrical connection to the electric power supply section is formed at the near side of the fixing unit case in the inserting direction. Therefore, the electrical connection between the electric power supply section at the main body section and the connection section formed at the near side of the fixing unit case in the inserting direction can be established from the near side in the inserting direction.

Accordingly, the electrical connection between the heater and the main body section of the image forming apparatus can be carried out from the near side in the inserting direction in which the fixing device is inserted to the main body section. Therefore, the operation for establishing the electrical connection can more readily and surely be carried out. Further, the confirmation of whether the operation for establishing the electrical connection is surely carried out can be facilitated by the visual confirmation from the near side, for example.

(2-2) The connection section in the fixing device having the configuration disclosed in the aforesaid (2-1) may be collectively formed at one end portion of the fixing unit in the widthwise direction.

According to this configuration, the operation for establishing the electrical connection between the connection section and the main body section of the image forming apparatus can more simply be carried out.

(2-3) The connection section in the fixing device having the configuration disclosed in the aforesaid (2-1) and (2-2) may be formed so as to be exposed toward the transporting direction.

In this configuration, the connection section is exposed toward the transporting direction (the near side during the process for mounting the fixing device to the main body section) with the fixing device mounted to the main body section of the image forming apparatus. Accordingly, the operation for establishing the electrical connection between the connection section and the main body section of the image forming apparatus can more simply and surely be carried out. Further, the maintenance property of the fixing device and the image forming apparatus having the same is further enhanced.

(2-4) The fixing unit case and the facing roller support member in the fixing device having the configuration disclosed in the aforesaid (2-1) to (2-3) may be configured to expose the facing roller to the outside.

According to this configuration, the maintenance property of the fixing device and the image forming apparatus having the same is further enhanced.

According to this configuration, the cover member for covering the facing roller is omitted, so that the outer dimension of the fixing device is reduced. Accordingly, further miniaturization of the fixing device and the image forming apparatus having the same can be achieved.

(2-5) In the fixing device having the configuration disclosed in the aforesaid (2-1) to (2-4), a drive gear that can transmit rotational drive force from the main body section may be mounted to the end portion of the heat roller or the facing roller in the widthwise direction, and the connection section may be formed at the end portion of the fixing unit case in the widthwise direction that is opposite to a side where the drive gear is arranged.

According to this configuration, the drive gear is arranged at one end portion of the fixing unit case in the widthwise direction. Further, the connection section is arranged at the other end portion (the end portion where the drive gear is not arranged) of the fixing unit case in the widthwise direction.

According to this configuration, the electrical connection to the electric power supply section provided at the main body section of the image forming apparatus is established at the end portion of the fixing unit where the drive gear is not arranged. Accordingly, the workability of the electrical connection is further enhanced.

(2-6) The fixing device having the configuration disclosed in the aforesaid (2-1) to (2-5) further has a conductive member configured to electrically connect the heater with the connection section, wherein the conductive member may be arranged in the fixing unit case along a surface facing to the heat roller.

According to this configuration, the conductive member is arranged inside the fixing unit case without exposing to the outside of the fixing unit case. Moreover, the conductive member is arranged inside the fixing unit case so as not to be in contact with the heat roller. Consequently, the reliability in the operations of the fixing device is enhanced.

(2-7) In the fixing device having the configuration disclosed in the aforesaid (2-6), the conductive member may be made of a metallic member that is not covered by a cylindrical insulating coating member.

According to this configuration, it is unnecessary to coat the conductive member upon manufacturing the fixing device. Therefore, the production cost of the fixing device relating to the conductive member can be reduced. Notably, the conductive member may be the one in which a thin-film coating (e.g., such as a skin layer of an enameled wire) is formed beforehand on its surface.

(2-8) In the fixing device having the configuration disclosed in the aforesaid (2-6) and (2-7), the conductive member may be composed of a plate-like member and a linear member connected to the plate-like member.

According to this configuration, it can be inhibited that the surface of the conductive member is made close to the surface of the heat roller due to the heat deformation caused by the radiant heat from the heat roller, compared to the case where the whole conductive member is composed of the plate-like member. Therefore, the reliability of the operations of the fixing device and the image forming apparatus having the same is enhanced.

(2-9) The fixing device having the configuration disclosed in the aforesaid (2-1) to (2-8) may have a connection section cover configured to cover the connection section.

In this configuration, the connection section can be covered so as not to be exposed to the outside.

(2-10) In the fixing device having the configuration disclosed in the aforesaid (2-9), the connection section cover may be arranged at the near side in the inserting direction.

According to this configuration, the connection section cover can easily be attached and detached.

DESCRIPTION OF THE PREFERRED EMBODIMENT

Embodiments of the present invention (embodiments that are considered to be the best mode by the present applicant for the time being at the filing of this application) will be explained with reference to drawings.

<Entire Configuration of Laser Printer>

Figure 1:
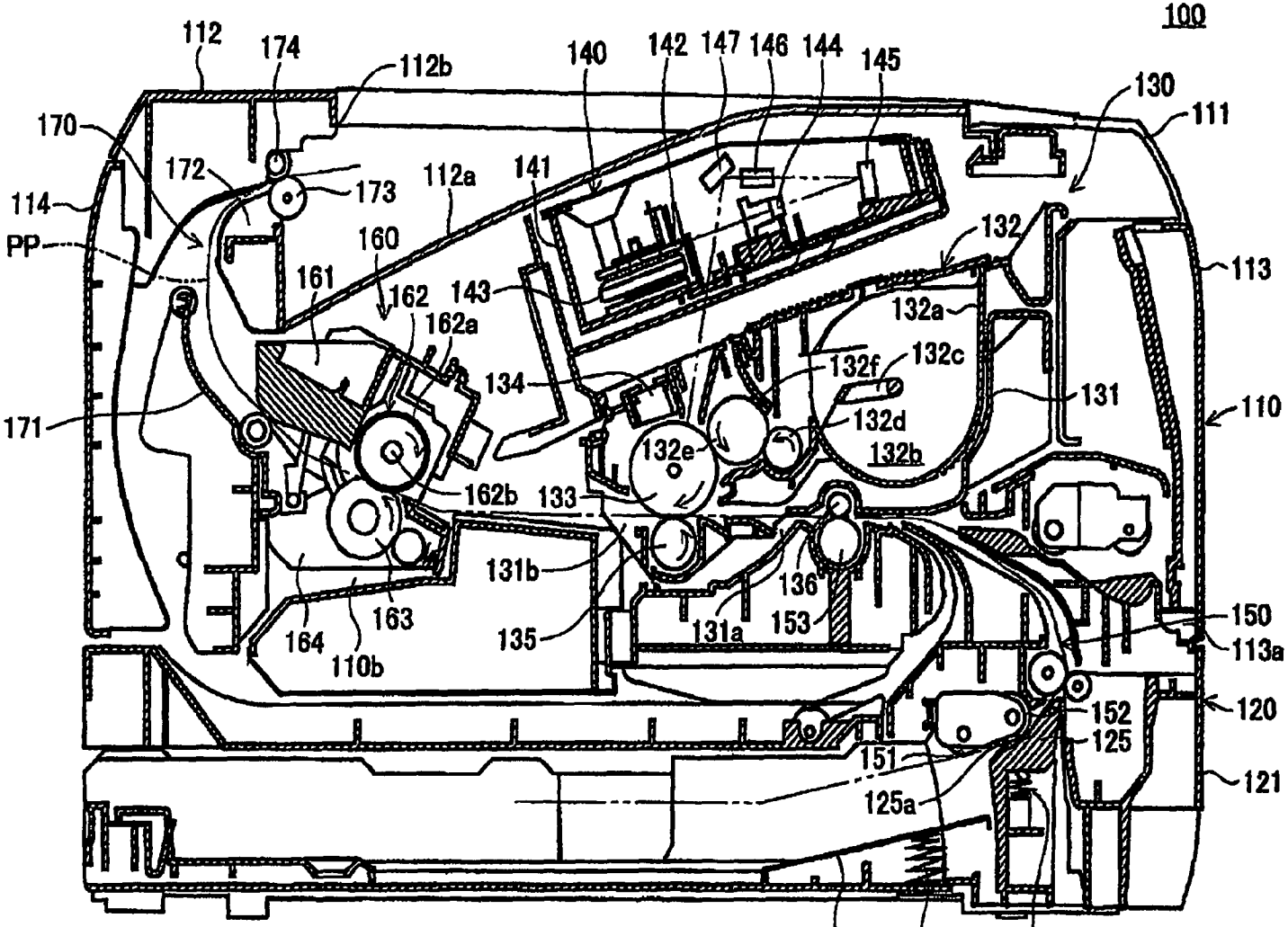
FIG. 1 is a side sectional view showing a schematic configuration of a laser printer according to an embodiment of the present invention.

FIG. 1 is a side sectional view of a laser printer 100 according to one embodiment of the image forming apparatus of the present invention.

The laser printer 100 has a main body 110 and a feeder unit 120 for feeding a recording medium (sheet) to the main body 110. A process cartridge 130 for forming an image by a developer (toner) onto the sheet is detachably mounted in the main body 110. A scanner unit 140 for applying a laser beam to a photosensitive drum 133 provided to the process cartridge 130 is arranged in the main body 110. Further, arranged in the main body 110 are a sheet feed section 150 for feeding a sheet to the process cartridge 130, a fixing unit 160 for fixing onto the sheet the image formed with a toner on the sheet by the process cartridge 130, and a sheet ejection section 170 for ejecting the sheet that has been subject to the fixing unit 160 to the outside of the laser printer 100.

<<Explanation of Terms "Sheet Transporting Direction", "Sheet Widthwise Direction", "Front Face", "Back Face">>

The laser printer 100 is configured such that the sheet is transported along the sheet transporting path PP (paper path that is shown by a two-dot-chain line in the figure). Therefore, in the following explanation, the direction from the feeder unit 120 toward the sheet ejection section 170 along the sheet transporting path PP in FIG. 1 is referred to as "sheet transporting direction".

The edge portion at the right side of the laser printer 100 in the figure is referred to as "front face", and the edge portion at the left side of the laser printer 100 in the figure is referred to as "back face". The side-to-side direction in FIG. 1 is the lengthwise direction of the laser printer 100.

The direction (i.e., the direction of the normal line in FIG. 1: the widthwise direction of the laser printer 100) vertical to the side-to-side direction in FIG. 1 (the lengthwise direction of the laser printer 100) and the vertical direction (height direction of the laser printer 100) is referred to as "sheet widthwise direction".

<<Configuration of Casing of Main Body>>

An outer cover 111 constituting the casing cover of the main body 110 has a shape of a generally rectangular. It is integrally made of a synthetic resin plate. This outer cover 111 is formed so as to cover the main body frame (later-described main body frame 110*a*: see FIG. 6) that supports various components accommodated in the main body 110.

A top cover 112 constitutes the upper face of the outer cover 111. A recess section that becomes shallow toward the front face side (right side in the figure) is formed at the back face side (left side in the figure) of the top cover 112. The bottom face of the recess section forms a catch tray 112*a* on which the sheet having the image formed thereon is placed. Specifically, this catch tray 112*a* is composed of a slope formed to extend diagonally down toward the back face side (left side in the figure) from the front face side (right side in the figure) of the top cover 112. A sheet ejection port 112*b* made of an opening section is provided above the lower end portion (the end portion at the lower left side in the figure) of the catch tray 112*a* at the outer cover 111. Specifically, the aforesaid catch tray 112*a* receives the sheet that is ejected from the sheet ejection port 112*b* and has an image formed thereon, and stacks thereon about one hundred sheets having an image formed thereon.

A front cover 113 is attached to the outer cover 111 at the front face side. This front cover 113 is supported by the outer cover 111 so as to be capable of being opened and closed by the pivot movement about a hinge section 113*a* at its lower end portion. The laser printer 100 in this embodiment is configured such that the process cartridge 130 can be attached to or detached from the laser printer 100 at its front face side by opening the front cover 113 toward the front face side (right side in the figure).

A rear cover 114 is arranged at the outer cover 111 at the back face side. This rear cover 114 is detachably mounted to the outer cover 111 so as to be removed when a fixing unit 160 is attached to a fixing unit mounting section 110*b* positioned in the main body 110 at the back face side. Specifically, the outer cover 111 and the rear cover 114 are configured such that the rear cover 114 can be detached from the outer cover 111 in the case where the fixing unit 160 is inserted into the main body 110 along a predetermined inserting direction (rightward direction in the figure).

<<Configuration of Feeder Unit>>

A feeder case 121 constituting the casing of the feeder unit 120 is configured to be capable of accommodating therein a great number of sheet-like papers in a stacked state. In the feeder case 121, a sheet pressing plate 123, a sheet pressing spring 124, a separation pad holder 125 and a separation pad urging spring 126 are arranged.

The sheet pressing plate 123 is pivotably supported about its end portion at the back face side (the side away from the separation pad holder 125). The end portion of the sheet pressing plate 123 at the front face side (the side close to the separation pad holder 125) is urged in the upward direction by the sheet pressing spring 124. The separation pad holder 125 is arranged in the vicinity of the end portion of the feeder case 121 at the front face side and is arranged at the downstream side of the sheet transporting direction from the sheet pressing plate 123. The separation pad 125*a* made of a material having a friction coefficient greater than that of the sheet such as rubber is arranged at the position above the separation pad holder 125 and facing the sheet transporting path PP. The separation pad urging spring 126 for urging the separation pad 125*a* in the upward direction is arranged below the separation pad holder 125.

<<Configuration of Process Cartridge>>

A developing cartridge 132 is detachably mounted to the process cartridge 131 constituting the casing and the frame of the process cartridge 130. The developing cartridge 132 is arranged at the back face side of the photosensitive drum 133 accommodated in the process case 131. The photosensitive drum 133 is a cylindrical member having a photosensitive layer at its peripheral portion. The photosensitive drum 133 is supported by the process case 131 so as to be capable of rotating in the direction shown by an arrow in the figure in synchronism with the transportation of the sheet upon the image formation. Further, the photosensitive drum 133 is arranged such that its rotational center shaft is parallel to the sheet widthwise direction. The developing cartridge 132 is configured as follows such that toner is supplied to the peripheral surface of the photosensitive drum 133 having a latent image formed thereon to thereby carry the toner onto the peripheral surface as arranged in an image shape (to develop the latent image by toner).

<<<Configuration of Developing Cartridge>>>

A toner storing chamber 132*b* for storing toner is formed at the developing cartridge case 132*a*, which constitutes the casing of the developing cartridge 132, at the front face side. An agitator 132*c* for stirring toner stored in the toner storing chamber 132*b* is accommodated in the toner storing chamber 132*b*. The agitator 132*c* is a member of an impeller shape, and it is supported so as to be capable of rotating in the direction shown by an arrow in the figure about the rotational shaft parallel to the sheet widthwise direction by the developing cartridge case 132*a*.

A supply roller 132*d* and developing roller 132*e* are arranged in the space in the developing cartridge case 132*a* close to the back face side from the toner storing chamber 132*b*. An opening section through which toner can pass is formed at the wall of the toner storing chamber 132*b* at the back face side, whereby toner passing through the opening section by the rotation of the agitator 132*c* can reach the supply roller 132*d*.

The supply roller 132*d* is made by forming a sponge layer at the outer peripheral portion of the metallic rotational center shaft. The supply roller 132*d* is arranged so as to be in contact with the peripheral surface of the developing roller 132*e*, and is rotatably supported to the developing cartridge 132*a*. The supply roller 132*d* is driven to rotate in the direction shown by an arrow in the figure, which makes it possible to carry the charged toner on the peripheral surface of the developing roller 132*e*.

The developing roller 132*e* is made by forming a semiconductive rubber layer, which is made by mixing synthetic resin into a carbon black, at the outer peripheral portion of the metallic rotational center shaft. This developing roller 132*e* is driven to rotate in the direction shown by an arrow in the figure (i.e., the direction same as that of the supply roller 132*d*) as being in contact with the supply roller 132*d*, which makes it possible to carry the charged toner onto the peripheral surface of the developing roller 132*e*.

The developing roller 132*e* is rotatably supported by the developing cartridge case 132*a* such that the developing roller 132*e* is arranged parallel to the peripheral surface of the photosensitive drum 133 with a predetermined clearance with the developing cartridge 132 mounted to the process case 131. Specifically, the process case 131 and the developing cartridge case 132*a* are configured such that the peripheral surface of the developing roller 132*e* exposing toward the outer side of the developing cartridge case 132*a* faces the peripheral surface of the photosensitive drum 133 via a thin layer of toner carried onto the peripheral surface of the developing roller 132*e*.

A layer thickness regulating blade 132*f* is arranged at the back face side (at the front side of the direction of rotation of the developing roller 132*e*) with respect to the contact portion of the developing roller 132*e* and the supply roller 132*d*. The layer thickness regulating blade 132*f* is arranged so as to adjust the thickness of the toner layer, density and charge quantity of toner on the developing roller 132*e* due to the contact of its leading end to the peripheral surface of the developing roller 132*e*.

<<<Configurations and Arrangements of Other Components in Process Case>>>

A charger 134 for uniformly charging the peripheral surface of the photosensitive drum 133 is arranged above the photosensitive drum 133. This charger 134 is supported by the process case 131. An opening that is for applying a laser beam onto the peripheral surface of the photosensitive drum 133 and that is a path of the laser beam is formed at the upper section of the process case 131. Specifically, the opening is formed such that the latent image can be formed onto the peripheral surface of the photosensitive drum 133 by the irradiation of the laser beam modulated in accordance with the image information to the peripheral surface of the uniformly charged photosensitive drum 133 through the opening.

A transfer roller 135 for transferring the toner carried onto the peripheral surface of the photosensitive drum 133 onto the sheet is accommodated in the process case 131. This transfer roller 135 is arranged below the photosensitive drum 133 and at the bottom portion of the process cartridge 130 such that the upper portion of its peripheral surface is facing the photosensitive drum 133. The transfer roller 135 is rotatably supported by the process case 131. The transfer roller 135 is configured to be capable of transferring the toner carried on the peripheral surface of the photosensitive drum 133 onto the sheet by the application of predetermined voltage between the photosensitive drum 133 and the transfer roller 135 as the transfer roller 135 is driven to rotate in the direction opposite to the rotation of the photosensitive drum 133 (in the direction shown by an arrow in the figure: counterclockwise direction) in synchronism with the rotation of the photosensitive drum 133 in the direction shown by an arrow in the figure (clockwise direction) upon the image formation.

A sheet inlet port 131*a* that is an opening for introducing the sheet into the process case 131 (the aforesaid transfer position) is formed at the bottom portion of the process case 131 and at the upstream side of the sheet transporting direction from the position where the photosensitive drum 133 and the transfer roller 135 face each other. A sheet outlet port 131*b* that is an opening for ejecting the sheet from the process case 131 is formed at the bottom portion of the process case 131 and at the downstream side of the sheet transporting direction from the aforesaid transfer position.

An upper resist roller 136 for adjusting the direction and transporting timing of the sheet is rotatably supported at the outside of the process case 131 and at the upstream side of the sheet transporting direction from the sheet inlet port 131*a*.

<<Configuration of Scanner Unit>>

A scanner unit 140 is arranged above the process case 131. The scanner unit 140 has a scanner case 141, a polygon mirror 142, a polygon motor 143, an f-θ lens 144, a reflection mirror 145, a cylindrical lens 146, and a reflection mirror 147.

The polygon mirror 142 is supported by the rotational drive shaft of the polygon motor 143, which is fixed to the scanner case 141, so as to be rotatably driven with a predetermined number of revolutions. The polygon mirror 142 is configured to be capable of scanning a laser beam, which is generated at an unillustrated laser beam generating section on the basis of the image data, along the sheet widthwise direction, while rotatably driven by the aforesaid polygon motor 143.

The f-θ lens 144 is a lens for correcting the scanning interval of the laser beam (shown by one-dot-chain line in the figure) reflected by the polygon mirror 142. It is configured to have the longitudinal direction along the rotating direction of the polygon mirror 142. This f-θ lens 144 is arranged between the polygon mirror 142 and the reflection mirror 145.

The cylindrical lens 146 is a lens for cross-scan error compensation, and it is arranged at the place where the laser beam reflected by the reflection mirror 145 via the f-θ lens 144 advances. The reflection mirror 147 is arranged such that the laser beam via the cylindrical lens 146 can be applied to the peripheral surface of the photosensitive drum 133.

The f-θ lens 144, reflection mirror 145, cylindrical lens 146, and reflection mirror 147 are held in the scanner case 141.

<<Configuration of Sheet Feed Section>>

A sheet feed section 150 has a pickup roller 151, a separation roller 152, and a lower resist roller 153. It is configured to pick up sheets one by one from the feeder unit 120 and feed the sheets to the aforesaid transfer position (the position where the photosensitive drum 133 and the transfer roller 135 are facing each other) in the process cartridge 130.

The pickup roller 151 is rotatably supported to the main body 110 (the aforesaid main body frame: see a later-described main body frame 10*a* in FIG. 6). This pickup roller 151 is arranged so as to face the end portion of the sheet pressing plate 123 at the front face side in the feeder unit 120 in order that the pickup roller 151 is brought into contact with the leading end of the sheet accommodated in the feeder case 121 in a stacked state.

The separation roller 152 is rotatably supported to the main body 110. The separation roller 152 is arranged at the position facing the separation pad 125*a*. Specifically, the separation roller 152 is arranged so as to be capable of being in contact with the separation pad 125*a* by the separation pad urging spring 126 with a predetermined pressure.

The lower resist roller 153 is a roller for adjusting the direction and transporting timing of the sheet in cooperation with the aforesaid upper resist roller 136. It is arranged at the upstream side of the sheet transporting direction from the position where the photosensitive drum 133 and the transfer roller 135 face each other, so as to be in contact with the upper resist roller 136.

In the sheet feed section 150, a guide member, rollers, or other components for guiding the transportation of the sheet are appropriately arranged between the separation roller 152 and the lower resist roller 153, between the lower resist roller 153 and the sheet inlet port 131*a* at the bottom portion of the process case 131, and between the sheet outlet opening 131*b* at the bottom portion of the process case 131 and the fixing unit 160.

<<Schematic Configuration of Fixing Unit>>

The fixing unit 160 is arranged at the downstream side of the sheet transporting direction from the aforesaid transfer position (the position where the photosensitive drum 133 and the transfer roller 135 face each other). The fixing unit 160 has a fixing unit case 161, a heat roller 162, a pressure roller 163, and a pressure roller support member 164.

The fixing unit case 161 is interposed between the process cartridge 130 and the heat roller 162 to cover the heat roller 162 so as to be capable of inhibiting the process cartridge 130 from being heated by radiation heat from the heat roller 162 as soon as possible.

The heat roller 162 is formed by accommodating a heater 162*b* for heating and melting the toner attached onto the sheet in a roller main body 162*a* that is a metallic thin hollow cylindrical member whose surface is subject to a parting treatment. Both end portions of the heat roller 162 in the sheet widthwise direction are rotatably supported by the fixing unit case 162. The heat roller 162 is arranged along the sheet widthwise direction that is perpendicular to the aforesaid sheet transporting direction and sheet thickness direction.

The pressure roller 163 is made of silicon rubber. It is arranged parallel to the heat roller 162 and facing the heat roller 162 so as to be pressed against the heat roller 162 with a predetermined pressure. Both end portions of the pressure roller 163 in the sheet widthwise direction are rotatably supported by the pressure roller support member 164.

The pressure roller support member 164 is a member for rotatably supporting the pressure roller 163. It is arranged at the lower portion of the fixing unit case 161. Specifically, the pressure roller support member 164 is supported so as to be capable of pivoting along the vertical direction in the figure at both end portions of the fixing unit case 161 in the sheet widthwise direction.

This fixing unit 160 is mounted to the main body 110 (the aforesaid main body frame: see the later-described main body frame 110*a* in FIG. 6). It is configured such that the pressure roller 163 follows the rotation of the heat roller 162 in the direction shown by an arrow in the figure through a power transmission mechanism provided to the main body 110, to rotate in the direction shown by an arrow in the figure. The fixing unit 110 is further configured as follows. Specifically, the sheet is nipped between the heat roller 162 and the pressure roller 163 rotating in the direction shown by the arrow in the figure, whereby the toner attached onto the surface of the sheet (the upper surface in the figure) is fixed onto the sheet, while the sheet can be fed in the sheet transporting direction. The detailed configuration of the fixing unit 160 will be described later.

<<Configuration of Sheet Ejection Section>>

The sheet ejection section 170 is composed of a first sheet ejection guide 171, a second sheet ejection guide 172, a first sheet ejection roller 173, and a second sheet ejection roller 174.

The first sheet ejection guide 171 is a member for guiding the sheet subject to the fixing unit 160 along the sheet transporting path PP. It is arranged at the downstream side of the sheet transporting direction from the fixing unit 160. The second sheet ejection guide 172 is a member for guiding the sheet through the first sheet ejection guide 171 toward the sheet ejection port 112*b*. It is arranged at the upstream side of the sheet transporting direction from the sheet ejection port 112*b*.

The first sheet ejection roller 173 and the second sheet ejection roller 174 are arranged so as to face each other across the sheet transporting path PP. The first sheet ejection roller 173 is arranged below the sheet transporting path PP. It is rotatably supported by the main body 110 (the aforesaid main body frame: see a later-described main body frame 110*a* in FIG. 6). The first sheet ejection roller 173 is configured to be driven to rotate via the power transmission mechanism provided to the main body 110. The second sheet ejection roller 174 is rotatably supported by a top cover 112. It follows the rotation of the first sheet ejection roller 173.

Further, in the sheet ejection section 170, roller members are arranged at suitable positions between the fixing unit 160 and the sheet ejection port 112*b* and along the sheet transporting path PP.

<Detail Configuration of Fixing Unit>

Figure 2:
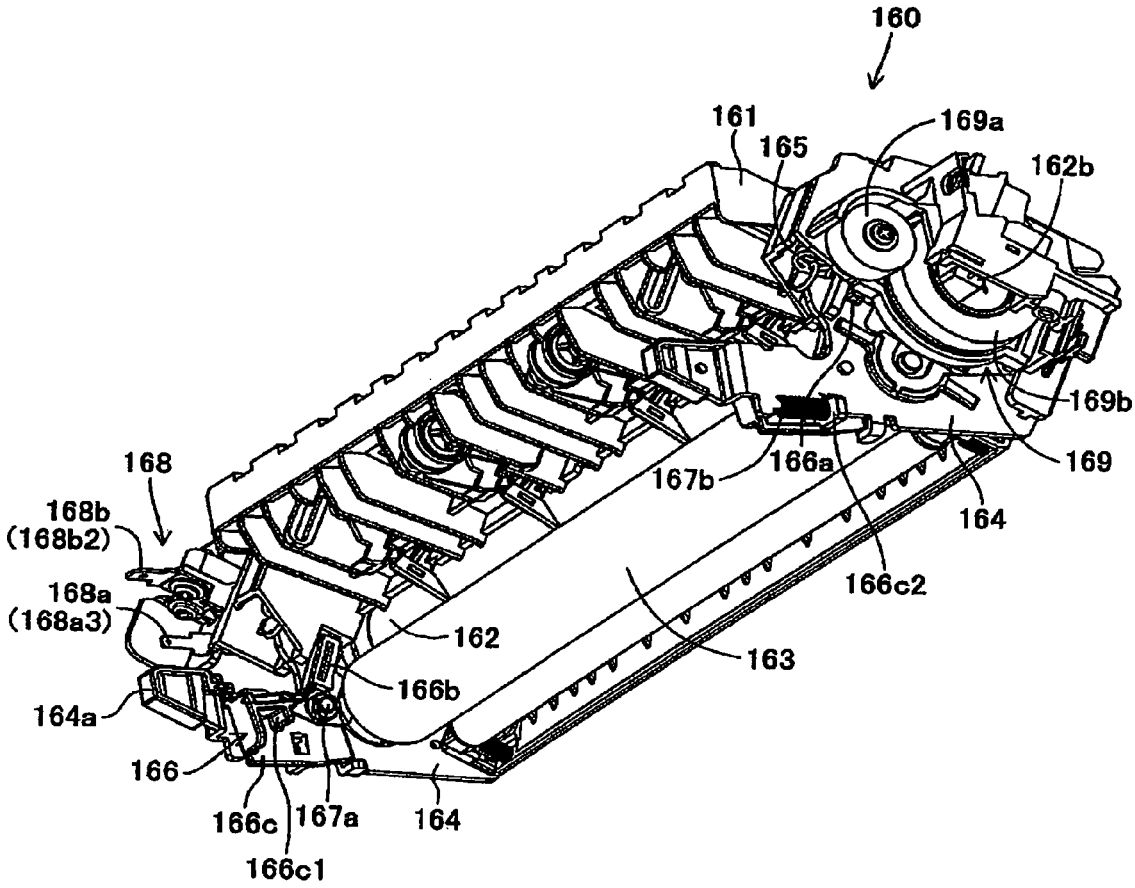
FIG. 2 is a perspective view of the fixing unit shown in FIG. 1 seen from diagonally below.

FIG. 2 is a perspective view of the fixing unit 160 seen from the diagonal lower side.

As shown in FIG. 2, the fixing unit case 161 and the pressure roller support member 164 are configured to expose the pressure roller 163 toward the outside (the downstream side of the sheet transporting direction and lower side) (see later-described FIGS. 7 and 8).

The pressure roller support member 164 is pivotably supported by the fixing unit case 161 as described above. A handle 164*a* for manually pivoting the pressure roller support member 164 is provided to the free end of the pressure roller support member 164. A pressure spring 165 serving as a tension spring is bridged between the fixing unit case 161 and the pressure roller support member 164. The pressure spring 165 is configured to bring the pressure roller 163 into a pressure contact with the heat roller 162 by urging the pressure roller support member 164 toward the fixing unit case 161.

A spacer member 166 is mounted at the position of the pressure roller support member 164 close to the center of the pivot from the aforesaid handle 164*a*. The spacer member 166 is a member for changing the press-contact state between the heat roller 162 and the pressure roller 163 by adjusting the positional relationship between the fixing unit case 161 and the pressure roller support member 164. This spacer member 166 is pivotably supported about a pivot pin 167*a* that is provided so as to project in the horizontal direction from the pressure roller support member 164.

Specifically, the spacer member 166 is composed of a spacer section 166*a*, a spacer support section 166*b*, and a spacer operation section 166*c*. The spacer section 166*a* is integrally formed by injection molding of a synthetic resin.

The spacer section 166*a* is a projection formed so as to extend in the horizontal direction from the upper end of the spacer support section 166*b*. It can be nipped between the lower end face of the fixing unit case 161 and the upper end face of the pressure roller support member 164 by the pivot movement of the spacer support section 166*b* in the rightward direction in the figure.

The spacer support section 166*b* is a member for supporting the spacer section 166*a*. It is arranged at the opposite side of the spacer operation section 166*c* across the pivot pin 167*a*.

The spacer operation section 166*c* is arranged at the position proximate to the handle 164*a* at the pressure roller support member 164. An operation rib 166*c*1 that is operated with fingers is provided so as to project toward the inner side along the sheet widthwise direction at the free end side of the spacer operation section 166*c* and at the downstream side of the sheet transporting direction. Further, a plate-like (rib-like) spring contact section 166*c*2 is provided so as to project from the lower end portion of the spacer operation section 166*c* toward the outer side along the sheet widthwise direction. The spacer urging spring 167*b* that is a compression spring is arranged between the spring contact portion 166*c*2 and the portion of the pressure roller support member 164 in the vicinity of the handle 164*a*. The spacer urging spring 167*b* is configured to be capable of urging the spacer support section 166*b* toward the right in the figure.

<<Configuration for Electrical Connection Between Heater and Main Body>>

The fixing unit 160 is provided with a heater conducting section 168 for electrical connection between a heater 162*b* and the main body 110 (see FIG. 1). This heater conducting section 168 has a first connection member 168*a* and a second connection member 168*b*. The first connection member 168*a* and the second connection member 168*b* are electrode members made of a metal plate for establishing electrical connection with a power source substrate provided to the main body 110 (see FIG. 1). They are mounted to the fixing unit case 161.

As apparent from FIG. 2, the first connection member 168*a* and the second connection member 168*b* are collectively provided at one end of the fixing unit case 161 in the sheet widthwise direction. Further, the first connection member 168*a* and the second connection member 168*b* are provided at the end section of the fixing unit case 161 in the downstream side of the sheet transporting direction.

A rotational drive force transmission section 169 for applying rotational drive force to the heat roller 162 is arranged at the other end, which is opposite to the above-mentioned one end in the sheet widthwise direction, in the fixing unit case 161. The rotational drive force transmission section 169 is composed of a transmission gear 169*a* and heat roller drive gear 169*b*.

The transmission hear 169*a* is rotatably supported at the above-mentioned other end in the fixing unit case 161. This transmission gear 169*a* is arranged such that its lower side is exposed to the outside of the fixing unit case 161 in order to receive the transmission of the rotational drive force from the drive source provided to the main body 110 (see FIG. 1) (also see later-described FIGS. 7 and 8).

The heat roller drive gear 169*b* is provided at the end section of the heat roller 162 in the sheet widthwise direction. The heat roller drive gear 169*b* meshes with the aforesaid transmission gear 169*a* on generally the same plane, whereby the rotational drive force from the aforesaid drive source provided to the main body 110 (see FIG. 1) can be transmitted to the heat roller drive hear 169*b* via the transmission gear 169*a*.

<<Detailed Configuration of Heater Conducting Section>>

Figure 3:
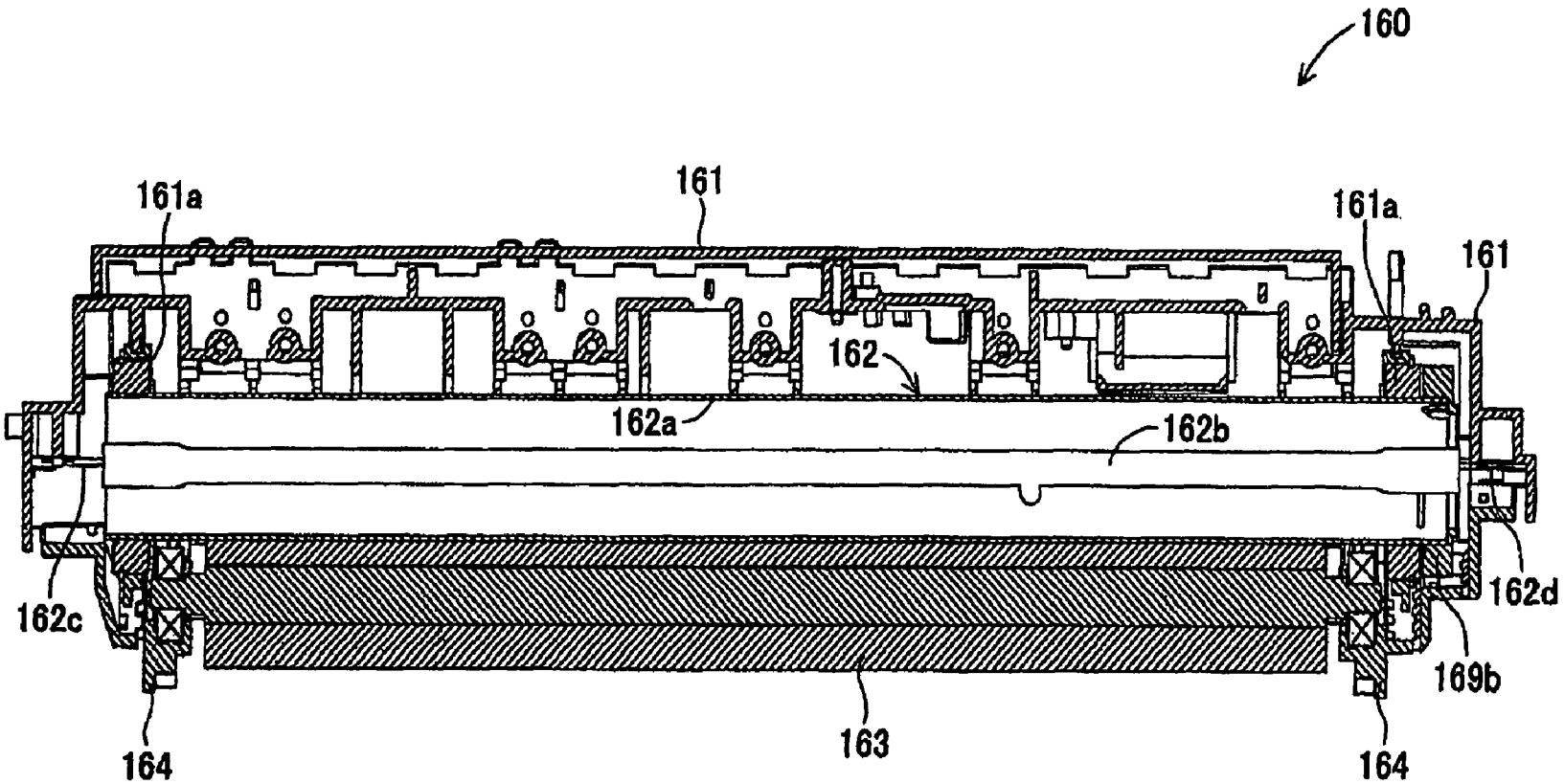
FIG. 3 is a sectional view of the fixing unit shown in FIG. 2 seen from the top.
Figure 4:
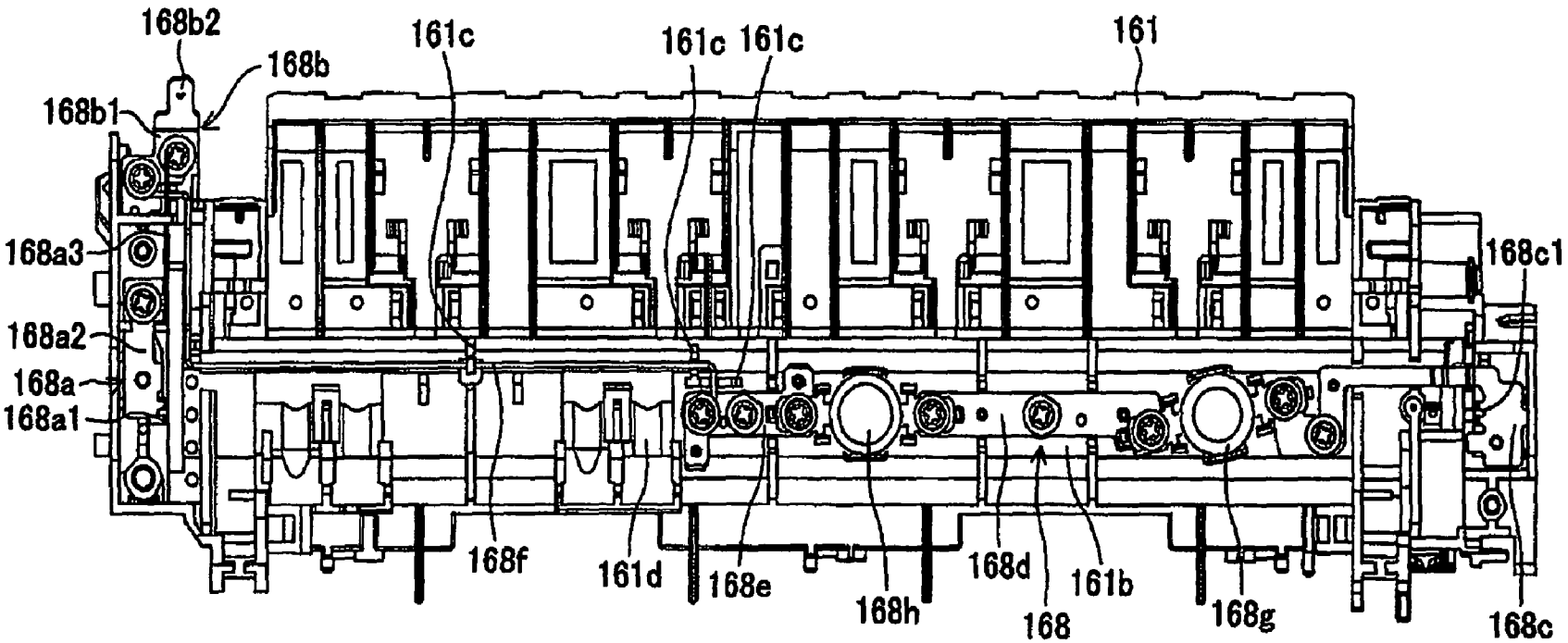
FIG. 4 is a view of the bottom face of the fixing unit case shown in FIG. 2 from which the heat roller is removed.
Figure 5:
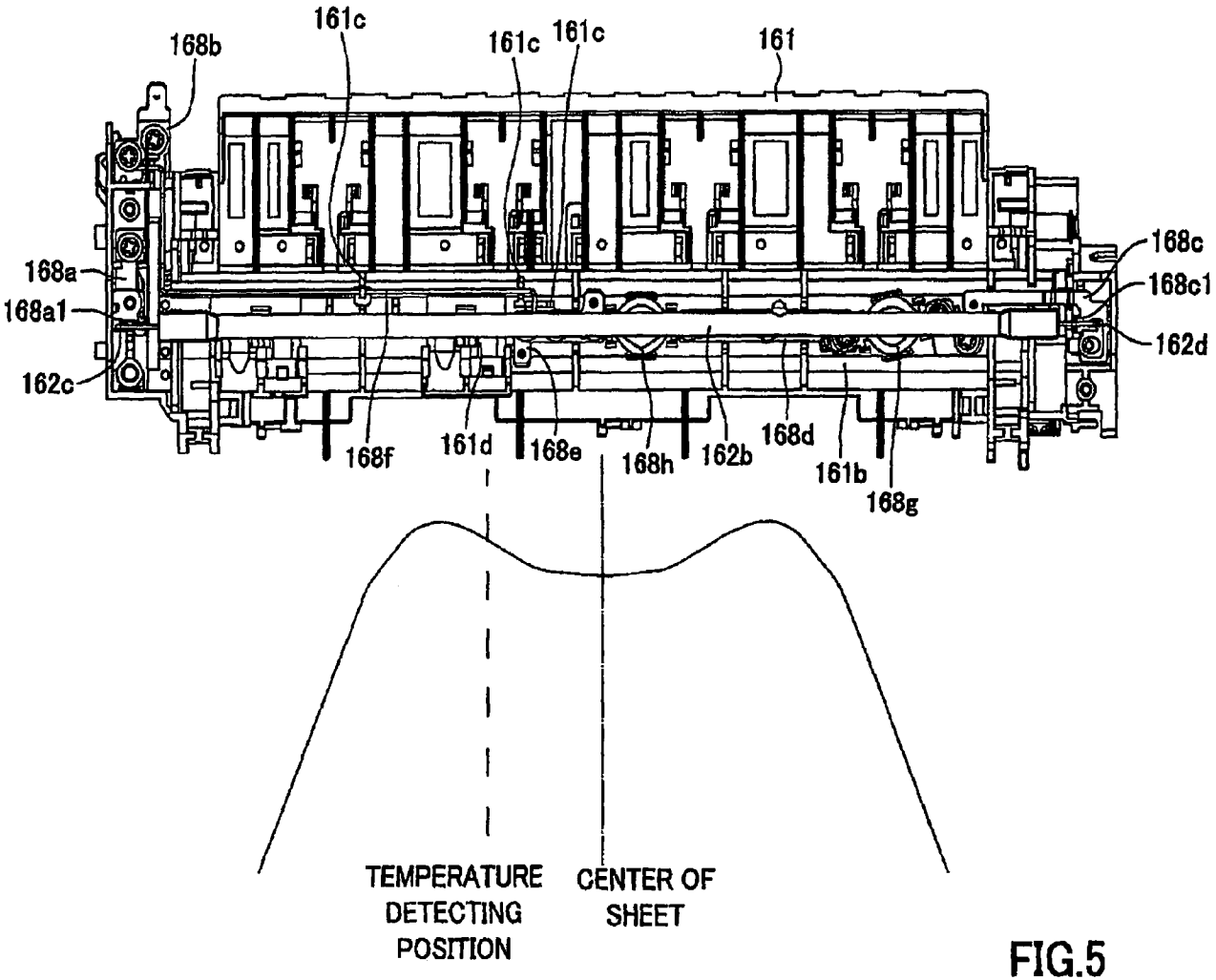
FIG. 5 is a view showing the positional relationship between the fixing unit case shown in FIG. 4 and the heater, and a light distribution profile at the heater.

FIG. 3 is a sectional view of the fixing unit 160 seen from the top. FIG. 4 is a view, seen from below, of the fixing unit case 161 from which the heat roller 162 is removed. FIG. 5 is a view showing the positional relationship between the fixing unit case 161 shown in FIG. 4 and the heater 162*b*. Notably, a light distribution profile (profile of light-emitting intensity of a halogen lamp) at the heater 162*b* is represented at the lower section in FIG. 5.

As shown in FIG. 3, the heat roller 162 is rotatably supported via a pair of heat roller bearings 161*a* provided in the fixing unit case 161.

The heater 162*b* is composed of a halogen lamp. A first terminal 162*c* and a second terminal 162*d* are provided at both end sections of the heater 162*b* in the sheet widthwise direction. The heater 162*b* generate heat by the electric power supply via the first terminal 162*c* and the second terminal 162*d*.

Referring to FIGS. 4 and 5, the heater conducting section 168 has a first connection member 168*a*, a second connection member 168*b*, a second terminal support member 168*c*, a first plate-like member 168*d*, a second plate-like member 168*e*, and a wire member 168*f*.

A terminal fixing section 168*a*1 that can fix the first terminal 162*c* of the heater 162*b* is formed at the first connection member 168*a*. The terminal fixing section 168*a*1 is a portion projecting rib-like from the end portion of the plate-like base section 168*a*2 fixed to the heat roller facing surface 161*b* that is the bottom surface (the surface facing to the heat roller 162 in FIG. 1) of the fixing unit case 161. A slit into which the first terminal 162*c* of the aforesaid heater 162*b* is fitted is formed at the terminal fixing section 168*a*1. Further, a plate-like connection terminal 168*a*3 is formed so as to project from the aforesaid base section 168*a*2 for establishing electrical connection between the fixing unit 160 (see FIGS. 2 and 3) and the outside (the main body 110 in FIG. 1). This connection terminal 168*a*3 is formed so as to project along the sheet transporting direction (in the upward direction in FIG. 4) (see FIG. 2).

The second connection member 168*b* is composed of a plate-like base section 168*b*1 fixed to the fixing unit case 161 and a connection terminal 168*b*2 formed to extend from the base section 168*b*1. This connection terminal 168*b*2 is also formed so as to project along the sheet transporting direction (see FIG. 2).

The second terminal support member 168*c* is a metallic plate-like member. A terminal fixing section 168*c*1 that has the same configuration as the terminal fixing section 168*a*1 in the above-mentioned first connection member 168*a* is formed at the second terminal support member 168*c*. The second terminal 162*d* of the heater 162*b* is fitted to the terminal fixing section 168*c*1, whereby the second terminal support member 168*c* can fix the second terminal 162*d*.

The first plate-like member 168*d* is a metallic plate-like member, and fixed to the heat roller facing surface 161*b*. A thermostat 168*g* is connected between the first plate-like member 168*d* and the second terminal support member 168*c*. The thermostat 168*g* is arranged so as to be capable of being in contact with one end of the roller main body 162*a* (see FIG. 3) of the heat roller 162 in the sheet widthwise direction (lateral direction in FIG. 3 or FIG. 5). When the temperature at the aforesaid one end of the roller main body 162*a* becomes higher than the predetermined temperature, the thermostat 168*g* breaks the electrical connection between the first plate-like member 168*d* and the second terminal support member 168*c*, thereby being capable of cutting off the conduction to the heater 162*b*.

The second plate-like member 168*e* is a metallic plate-like member, and fixed to the heat roller facing surface 161*b*. A thermostat 168*h* is connected between the second plate-like member 168*e* and the first plate-like member 168*d*. The thermostat 168*h* is arranged so as to be capable of being in contact with generally the center portion of the roller main body 162*a* (see FIG. 3) of the heat roller 162 in the sheet widthwise direction (lateral direction in FIG. 3 or FIG. 5). When generally the center portion of the roller main body 162*a* becomes higher than the predetermined temperature, the thermostat 168*h* breaks the electrical connection between the first plate-like member 168*d* and the second plate-like member 168*e*, thereby being capable of cutting off the conduction to the heater 162*b*.

The second plate-like member 168*e* and the base section 168*b*1 at the second connection member 168*b* are electrically connected via the metallic wire member 168*f*. This wire member 168*f* is supported so as to keep a predetermined gap with the roller main body 162*a* of the heat roller 162 (see FIG. 3) by a wire support rib 161*c* provided to project from the heat roller facing surface 161*b* that is the bottom surface of the fixing unit case 161.

As described above, the second terminal 162*d* of the heater 162*b* and the second connection member 168*b* are electrically connected by plural metallic members (second terminal support member 168*c*, first plate-like member 168*d*, second plate-like member 168*e*, and wire member 168*f*) independently fixed to the fixing unit case 161.

It should be noted that the first connection member 168*a*, second connection member 168*b*, second terminal support member 168*c*, first plate-like member 168*d*, second plate-like member 168*e*, and wire member 168*f* are formed of a "bare" metallic member that is not coated with an insulating coating member made of a synthetic resin (e.g., vinyl chloride, or the like) used for a wiring cord, or an insulating sleeve of a wire.

A thermistor mounting section 161*d* to which a thermistor for detecting the temperature of the roller main body 162*a* (see FIG. 3) of the heat roller 162 is mounted is disposed to the fixing unit case 161. The thermistor mounting section 161*d* is disposed at the position offset toward the sheet widthwise direction from the center of the sheet and at the position close to the center of the sheet from the peak of the light distribution profile at the heater 162*b* (this position is preferable for controlling a fixing temperature by using the above-mentioned thermistor) shown in FIG. 5. It should be noted that the "center of the sheet" here means the center of the standard-size sheet having the usable maximum size in the sheet widthwise direction, when the standard-size sheet passes through the fixing unit 160 (see FIGS. 2 and 3).

<<Configuration of Electric Power Supply Section>>

Figure 6:
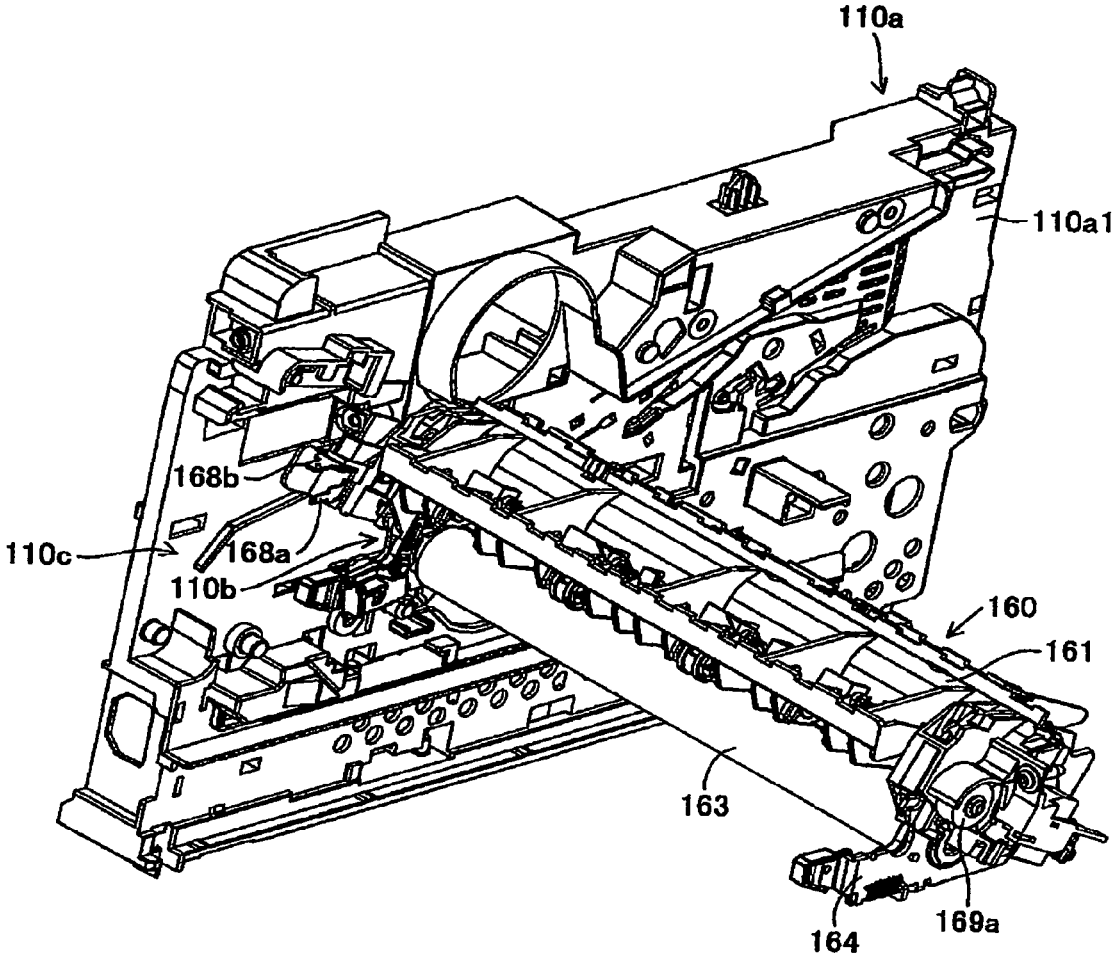
FIG. 6 is a perspective view, seen from diagonally above, showing the inside of the main body frame that constitutes the main body to which the fixing unit shown in FIG. 2 is mounted.

FIG. 6 is a perspective view, seen from diagonally above, showing the inside of the main body frame 110*a* to which the fixing unit 160 is mounted. FIG. 7 is a side view of the main body frame 110*a* from the inside.

Referring to FIG. 6, the main body frame 110*a* has a pair of side frames 110*a*1 arranged along the sheet widthwise direction. The side frames 110*a*1 are configured to be capable of supporting the fixing unit 160 at its both end portions in the sheet widthwise direction. Formed at the back face side of the main body frame 110*a* is a fixing unit insertion opening section 110*c* that is an opening section into which the fixing unit 160 is inserted.

The fixing unit insertion opening section 110*c* is formed so as to be open to the downstream side of the sheet transporting direction with respect to the fixing unit 160. Then, with the fixing unit 160 mounted to the main body frame 110*a*, the first connection member 168*a* and the second connection member 168*b* fixed to the fixing unit case 161 are arranged to be exposed from the fixing unit case 161 toward the downstream side of the aforesaid sheet transporting direction.

The fixing unit mounting section 110*b* is formed at the end portion of the fixing unit insertion opening section 110*c* at the front face side (at the front side of the direction in which the fixing unit 160 is inserted). The main body frame 110*a* is configured such that the fixing unit 160 can be mounted to the aforesaid fixing unit mounting section 110*c* by inserting the fixing unit 160 into the fixing unit insertion opening section 110*c* toward the front face side.

Figure 7:
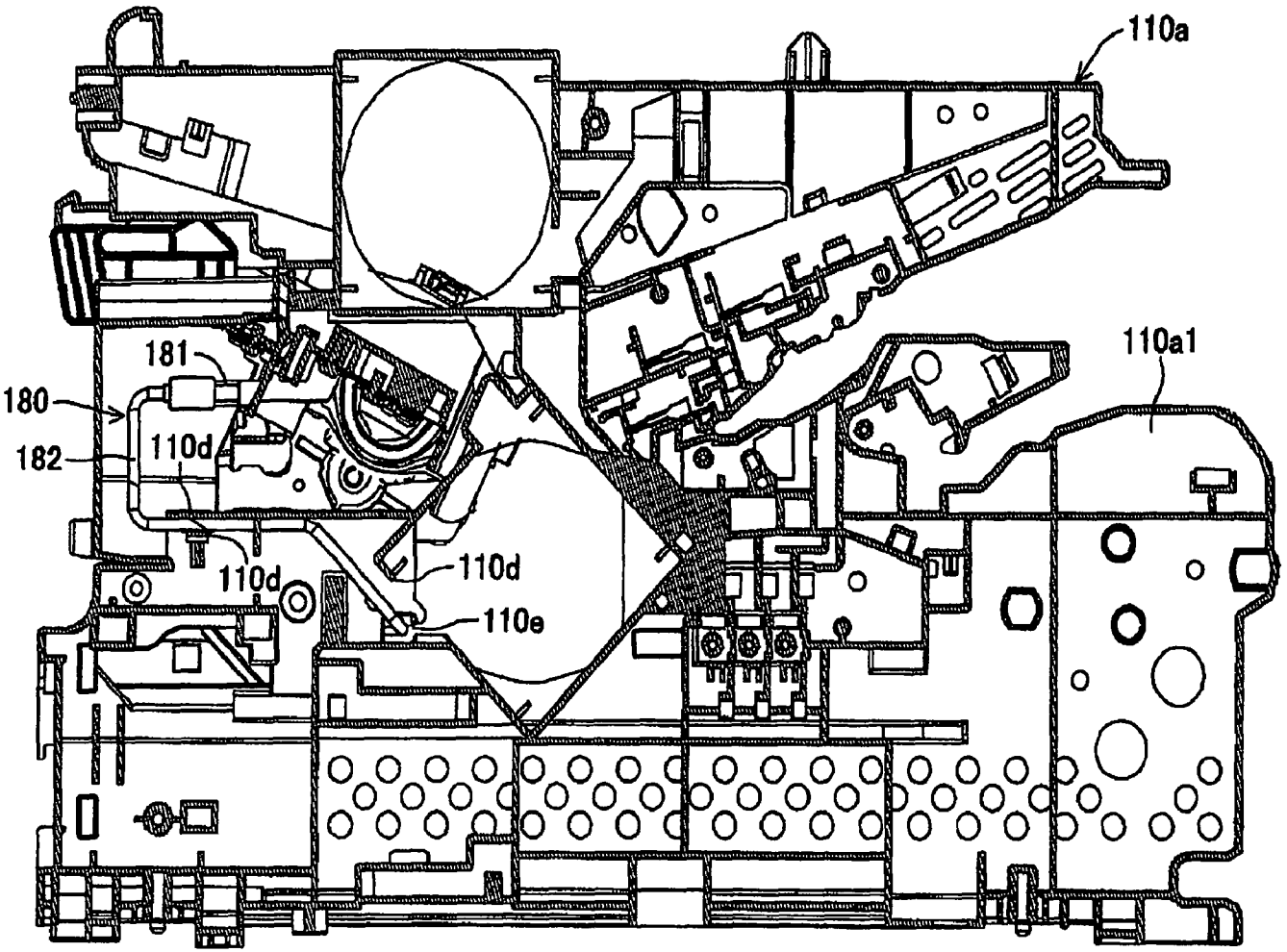
FIG. 7 is a side view of the main body frame shown in FIG. 6 from the inside.

With reference to FIG. 7, a fixing unit electric power supply section 180 is arranged at the inner side of the side frames 110*a*1 and at the back face side (at the left in the figure). This fixing unit electric power supply section 180 is a member for applying electric power to the fixing unit 160. It is composed of a connector 181 and a harness 182.

The connector 181 is arranged at the position facing the first connection member 168*a* and the second connection member 168*b* (see FIG. 6) at the fixing unit 160 that is mounted to the fixing unit mounting section 110*b*. Specifically, the connector 181 is arranged at the position proximate to the first connection member 168*a* and the second connection member 168*b* at the fixing unit 160 that is mounted to the fixing unit mounting section 110*b*. The connector 181 is arranged at the back face side (near side in the inserting direction of the fixing unit 160) of the fixing unit mounting section 110*b* (see FIG. 6).

The connector 181 is electrically connected by the harness 182 to the above-mentioned power supply substrate that is supported at the bottom portion of the main body frame 110*a* at the outer surface. The harness 182 is guided so as to pass below fixing unit 160 (see FIG. 6) by a harness guide 110*d* that is a rib-like member provided so as to project generally horizontally from the side frames 110*a*1, and a harness penetrating opening 110*e* formed at the side frames 110*a*1.

<<Connection Section Cover>>

Figure 8:
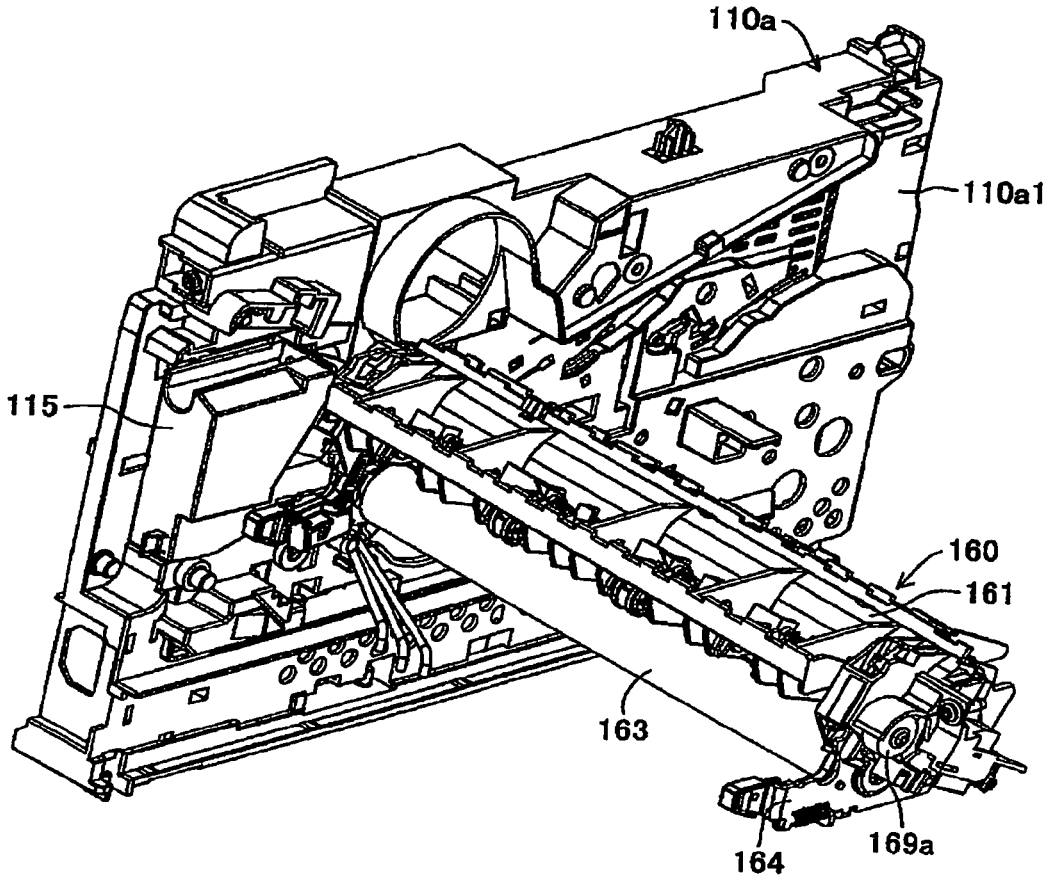
FIG. 8 is a perspective view showing the state in which a connection section cover is mounted to the main body frame and the fixing unit shown in FIG. 6.

FIG. 8 is a perspective view, seen from diagonally above like FIG. 6, of the inside of the main body frame 110*a* to which the fixing unit 160 is mounted.

A connection section cover 115 is mounted to the main body frame 110*a*. This connection section cover 115 is a box-like member made of a synthetic resin. It is arranged to cover the first connection member 168*a* and the second connection member 168*b* (see FIG. 6) when the fixing unit 160 is mounted to the main body frame 110*a*. This connection section cover 115 is arranged at the back face side (at the near side in the inserting direction of the fixing unit 160) of the first connection member 168*a* and the second connection member 168*b* (see FIG. 6) with the fixing unit 160 mounted to the main body frame 110*a*.

<Outline of Image Forming Operation by Laser Printer>

The outline of the image forming operation by the laser printer 100 having the above-mentioned configuration will be explained hereinafter with reference to FIG. 1.

<<Sheet Feeding Operation>>

Sheets accommodated in a stacked state in the feeder case 121 are urged upward toward the pickup roller 151 by the sheet pressing plate 123. Accordingly, several sheets from the uppermost sheet are brought into contact with the peripheral surface of the pickup roller 151. When the pickup roller 151 is driven to rotate counterclockwise in the figure, the leading end portions of the several sheets move in the rightward direction, and are nipped between the separation roller 152 and the separation pad 125*a*. When the separation roller 152 is driven to rotate counterclockwise in the figure, only the uppermost sheet that is brought into contact with the peripheral surface of the separation roller 152 is transported toward the position (resist position) where the upper resist roller 136 and a lower resist roller 155 come in contact with each other with the rotation of the separation roller 152.

The abutment of the leading end portions of the sheets against the resist position corrects the inclination of the sheet. Thereafter, the lower resist roller 155 is driven to rotate at a predetermined timing. Therefore, the upper resist roller 136 rotates as followed by the rotation of the lower resist roller 155, and further, the sheet is transported to the transfer position where the photosensitive drum 133 and the transfer roller 135 face each other. In this manner, the correction of inclination of the sheet and adjustment of the transporting timing are executed.

<<Carriage of Toner Image onto Peripheral Surface of Photosensitive Drum>>

During the transportation of the sheet toward the aforesaid transfer position as described above, a toner image is carried onto the peripheral surface of the photosensitive drum 133 as follows.

At first, the peripheral surface of the photosensitive drum 133 is uniformly charged by the charger 134. The laser beam scanned along the sheet widthwise-direction by the scanner unit 140 is applied onto the peripheral surface of the photosensitive drum 133 charged by the charger 134 and rotating in the direction shown by the arrow in the figure (clockwise direction). The laser beam is generated based upon the image data, as described above. Specifically, the light-emitting state (ON/OFF pulse shape) is modulated according to the image data. The modulated laser beam is scanned on the peripheral surface of the photosensitive drum 133, whereby the latent image is formed on the peripheral surface. The peripheral surface of the photosensitive drum 133 having the latent image formed thereon is rotated in the direction shown by the arrow in the figure (clockwise direction), so that it comes in contact with or in proximity to the peripheral surface of the developing roller 132*e*. The charged toner is uniformly carried on the peripheral surface of the developing roller 132*e* as described later.

The supply roller 132*d* rotates in the direction shown by an arrow in the figure (counterclockwise direction), so that toner is attached onto the peripheral surface of the developing roller 132*e*. The peripheral surface of the developing roller 132*e* having the toner attached thereon by the supply roller 132*d* rotates in the direction shown by the arrow in the figure (counterclockwise direction: i.e., the rotational direction same as that of the supply roller 132*d*), so that it reaches the contact position to the layer thickness regulating blade 132*f*. The amount of attachment and/or charge quantity of toner on the peripheral surface is adjusted by the layer thickness regulating blade 132*f*. In this manner, the peripheral surface having toner whose amount of attachment and/or charge quantity is adjusted rotates in the direction shown by the arrow in the figure (counterclockwise direction), whereby it reaches the position facing the photosensitive drum 133.

The peripheral surface of the photosensitive drum 133 having the latent image formed thereon and the peripheral surface of the developing roller 132*e* having the charged toner carried thereon come in contact with each other or in proximity to each other, whereby the toner is attached with a pattern corresponding to the latent image formed on the peripheral surface of the photosensitive drum 133. Specifically, the latent image on the peripheral surface of the photosensitive drum 133 is developed by the toner, and the toner image is carried onto the peripheral surface.

<<Transfer of Toner Image from Peripheral Surface of Photosensitive Drum to Sheet>>

The toner image carried onto the peripheral surface of the photosensitive drum 133 as described above is transported to the aforesaid transfer position by the rotation of this peripheral surface in the clockwise direction in the figure. Then, the toner image is transferred from the peripheral surface of the photosensitive drum 133 to the sheet at this transfer position.

<<Fixation and Sheet Ejection>>

The sheet having the toner image transferred thereon is sent to the fixing unit 160 along the sheet transporting path PP. This sheet is nipped between the heat roller 162 and the pressure roller 163 in order to apply pressure and heat. Thus, the toner image is fixed on the surface of the sheet. Thereafter; the sheet is sent to the sheet ejection port 112*b* via the sheet ejection section 170 by the rotations of the heat roller 162 and the pressure roller 163 in the direction shown by the arrow in the figure, and then, ejected onto the catch tray 112*a* via the sheet ejection port 112*b*.

<Operation and Effect by Configuration of Embodiment>

Subsequently, the operation and effect provided by the configuration of the aforesaid embodiment will be explained with reference to each drawing.

With reference to FIGS. 1, 6 and 7, the fixing unit mounting section 110*b* is formed at the main body frame 110*a* in the laser printer 100 in this embodiment. The fixing unit 160 is inserted to this fixing unit mounting section 110*b* along the inserting direction (in the rightward direction in FIG. 1), whereby the fixing unit 160 is mounted to the main body frame 110*a*.

The fixing unit electric power supply section 180 (connector 181) for supplying electric power to the fixing unit 160 is arranged at the near side in the inserting direction of the fixing unit mounting section 110*b*. Further, the first connection member 168*a* and the second connection member 168*b* for establishing electrical connection to the fixing unit electric power supply section 180 (connector 181) are formed at the near side in the inserting direction.

When assembling the laser printer 100 having the above-mentioned configuration, the fixing unit 160 is inserted into the main body frame 110*a* along the predetermined inserting direction, and mounted to the fixing unit mounting section 110*b*. Thereafter, the electrical connection between the fixing unit electric power supply section 180, and the first connection member 168*a* and the second connection member 168*b* is established from the near side in the inserting direction.

According to the laser printer 100 in this embodiment, the electrical connection between the fixing unit electric power supply section 180, and the first connection member 168*a* and the second connection member 168*b* is established at the near side in the inserting direction in which the fixing unit 160 is inserted into the main body frame 110*a*. Accordingly, the operation for the electrical connection is readily and surely carried out. Further, the confirmation of whether the electrical connection between the fixing unit electric power supply section 180, and the first connection member 168*a* and the second connection member 168*b* is surely carried out can be facilitated by the visual confirmation from the near side, for example.

In the case where the fixing unit 160 is detached from or attached to the main body frame 110*a* for maintenance of the laser printer 100, the operations for establishing the electrical connection and releasing the electrical connection between the fixing unit electric power supply section 180, and the first connection member 168*a* and the second connection member 168*b* are required. According to the laser printer 100 in this embodiment, these operations can readily and surely be carried out.

With reference to FIGS. 2, 6 and 7, the first connection member 168*a* and the second connection member 168*b* are collectively formed at one end of the fixing unit 160 in the direction (side-to-side direction in FIG. 4) perpendicular to the inserting direction, and the fixing unit electric power supply section 180 (connector 181) is formed at the position facing the first connection member 168*a* and the second connection member 168*b* in the configuration of this embodiment.

Accordingly, when the electrical connection between the fixing unit electric power supply section 180, and the first connection member 168*a* and the second connection member 168*b* is established, this electrical connection is readily established, since the fixing unit electric power supply section 180, the first connection member 168*a* and the second connection member 168*b* are collectively formed at one end of the fixing unit 160.

Moreover, as shown in FIG. 7, the harness 182 bridged between the fixing unit 160 and the main body frame 110*a* is collected at one end portion (one of the pair of side frames 110*a*1) of the fixing unit 160. Therefore, it can be inhibited that the harness 182 is caught between the heat roller 162 and the pressure roller 163. Further, the fixing unit 160 is easily attached to or detached from the main body frame 110*a* without detaching the connector 181 from the first connection member 168*a* and the second connection member 168*b* in the maintenance of the laser printer 100 in this embodiment, for example.

With reference to FIGS. 6 and 7, in the configuration of this embodiment, the fixing unit insertion opening section 110*c* to which the fixing unit 160 is mounted is formed at the main body frame 110*a*, the fixing unit mounting section 110*b* is composed of the portion at the front side of the inserting direction in the inner space of the fixing unit insertion opening section 110*c*, and the fixing unit electric power supply section 180 is arranged at the position proximate to the first connection member 168*a* and the second connection member 168*b*.

Accordingly, upon assembling the laser printer 100 in this embodiment, the fixing unit 160 is inserted along the inserting direction (diagonally upper-right direction that is the longitudinal direction of the side frame 110*a*1 in FIG. 6; rightward direction in FIG. 7) into the fixing unit insertion opening section 110*c* formed at the main body frame 110*a*. Then, the fixing unit 160 is mounted to the fixing unit mounting section 110*b* formed at the front end portion of the inner space of the fixing unit insertion opening section 110*c* in the in the inserting direction. At this time, the fixing unit electric power supply section 180 for supplying electric power to the fixing unit 160 is arranged at the near side of the fixing unit mounting section 110*b* in the inserting direction, as described above. Further, the fixing unit electric power supply section 180 is arranged at the position proximate to the first connection member 168*a* and the second connection member 168*b*. Specifically, the fixing unit electric power supply section 180 is formed at the position inside the fixing unit insertion opening section 110*c* at the main body frame 110*a* and corresponding to the first connection member 168*a* and the second connection member 168*b* at the fixing unit 160.

Accordingly, the electrical connection between the fixing unit electric power supply section 180, and the first connection member 168*a* and the second connection member 168*b* can more readily and surely be performed. The same is true for the maintenance of the laser printer 100 described above.

With reference to FIG. 6, in the configuration of this embodiment, the fixing unit insertion opening section 110*c* is formed to be open toward the sheet transporting direction, and the first connection member 168*a* and the second connection member 168*b* are formed to be exposed toward the sheet transporting direction from the fixing unit 160.

Accordingly, the workability upon mounting the fixing unit 160 to the main body frame 110*a* and upon establishing the electrical connection, and the maintenance property of the laser printer 100 can further be enhanced.

With reference to FIG. 6, in the configuration of this embodiment, the fixing unit case 161 and the pressure roller support member 164 are configured to expose the pressure roller 163 to the outside of the fixing unit 160. Therefore, the workability upon the maintenance operation, such as removal of paper jam is further enhanced.

The cover member for covering the pressure roller 163 is omitted, so that the outer dimension of the fixing unit 160 is reduced. Therefore, the fixing unit mounting section 110*b* at the main body frame 110*a* also has the minimum dimension. Accordingly, further miniaturization around the fixing unit 160 can be achieved in the laser printer 100 according to this embodiment, and hence, further miniaturization of the laser printer 100 can be achieved.

With reference to FIGS. 2, 6 and 7, in the configuration of this embodiment, the heat roller drive gear 169*b* that can transmit rotational drive force from the main body frame 110*a* is mounted to the end portion of the heat roller 162 or the pressure roller 163 in the widthwise direction, and the transmission gear 169*a* meshed with the heat roller drive gear 169*b* on the substantially same plane is mounted to the fixing unit case 161. The first connection member 168*a* and the second connection member 168*b* are formed at the end portion of the fixing unit case 161 in the widthwise direction that is opposite to the side where the transmission gear 169*a* and the heat roller drive gear 169*b* are arranged.

Therefore, the electrical connection between the fixing unit electric power supply section 180 (connector 181), and the first connection member 168*a* and the second connection member 168*b* is established at the end portion of the fixing unit 160 where the transmission gear 169*a* and the heat roller drive hear 169*b* are not arranged. Accordingly, the workability of the electrical connection is further enhanced. Moreover, it can be inhibited that the harness 182 is caught in the portion where the transmission gear 169*a* and the heat roller drive gear 169*b* are meshed with each other.

With reference to FIGS. 4 and 5, in the configuration of this embodiment, the fixing unit 160 is provided with the second terminal support member 168*c*, first plate-like member 168*d*, and second plate-like member 168*e*, which are made of a metallic plate, and the wire member 168*f* that is made of a metallic wire. They are metallic members for electrically connecting the heater 162*b*, and the first connection member 168*a* and the second connection member 168*b*. Each of the metallic members is fixed to the heat roller facing surface 161*b* that is the surface facing the heat roller 162 in the fixing unit case 161.

Specifically, each of these metallic members is divided into plural (small) sections in the sheet widthwise direction (side-to-side direction in FIGS. 4 and 5), and they are fixed to the fixing unit case 161 independent of one another. Further, each of these metallic members is arranged inside the fixing unit case 161 without exposing to the outside of the fixing unit case 161. Moreover, each of these metallic members is arranged inside the fixing unit case 161 along the heat roller facing surface 161*b*, which is the bottom face of the fixing unit case 161, so as not to be in contact with the heat roller 162.

Therefore, even if the heat (radiant heat from the surface of the roller main body 162*a* of the heat roller 162 in FIG. 3) generated from the heater 162*b* is transmitted to the aforesaid each of the metallic members and heat deformation is caused on each of these metallic members, the heat deformation is not so great, so that it is inhibited that the each of these metallic members is greatly departed from the proximate position to the heat roller facing surface 161*b* of the fixing unit case 161. Accordingly, it is inhibited that leak occurs due to the proximity of each metallic member to the surface of the heat roller 162. Consequently, the reliability in the operations of the laser printer 100 and the fixing unit 160 is enhanced.

Further, each of these metallic members is arranged along the aforesaid heat roller facing surface 161*b* with the "bare" state that means it is not covered by an insulating coating member made of a synthetic resin. Therefore, the production cost for the laser printer 100 and the fixing unit 160 can be reduced.

With reference to FIGS. 6 and 8, in the configuration of this embodiment, the connection section cover 115 for covering the first connection member 168*a* and the second connection member 168*b* is provided. Specifically, the connection section cover 115 covers the first connection member 168*a* and the second connection member 168*b* (and the connector 181 in FIG. 7) so as not to expose to the outside. Therefore, the safety of the laser printer 100 is further enhanced.

This connection section cover 115 is arranged at the near side in the inserting direction. Therefore, the connection section cover 115 can easily be attached and detached.

With reference to FIG. 7, in the configuration of this embodiment, the harness 182 is guided by the harness guide 10*d* formed at the side frames 110*a*1. Therefore, it can be inhibited that the harness 182 is caught at the movable section (e.g., between the heat roller 162 and the pressure roller 163, or between the transmission gear 169*a* and the heat roller drive gear 169*b* in FIG. 2) in the laser printer 100.

<Modified Example>

Notably, the embodiment that is considered to be the best by the present applicant for the time being at the filing of this application is only illustrated above. Therefore, the present invention is not limited to the aforesaid embodiment, and various modifications are naturally possible without departing from the spirit of the present invention.

Some of the modified examples will be illustrated below. It is needless to say that the modified examples are not limited thereto.

(i) An image forming apparatus to which the invention is applied is not limited to a laser printer. Further, the configurations unrelated to the gist of the invention, such as the feeder unit 120, process cartridge 130, scanner unit 140, or the like, can take various configurations other than those disclosed in the above-mentioned embodiment. For example, the present invention is preferably applicable to a configuration in which the feeder unit 120 is omitted and a sheet is only supplied manually.

(ii) The transmission gear 169*a* is arranged so as to mesh with the heat roller drive gear 169*b* mounted at the end portion of the heat roller 162 for rotatably driving the heat roller 162. Instead of this configuration, a pressure roller drive gear may be mounted to the end portion of the pressure roller 163, and the transmission gear 169*a* may drive the pressure roller 163 so as to rotate by the meshing between the pressure roller drive gear and the transmission gear 169*a*. Alternately, the heat roller drive gear 169*b* and the aforesaid pressure roller drive gear may be configured to mesh with each other, and the transmission gear 169*a* may drive the heat roller 162 and the pressure roller 163 so as to rotate by the meshing between the heat roller drive gear 169*b* or the pressure roller drive gear and the transmission gear 169*a*.

Figure 9A:
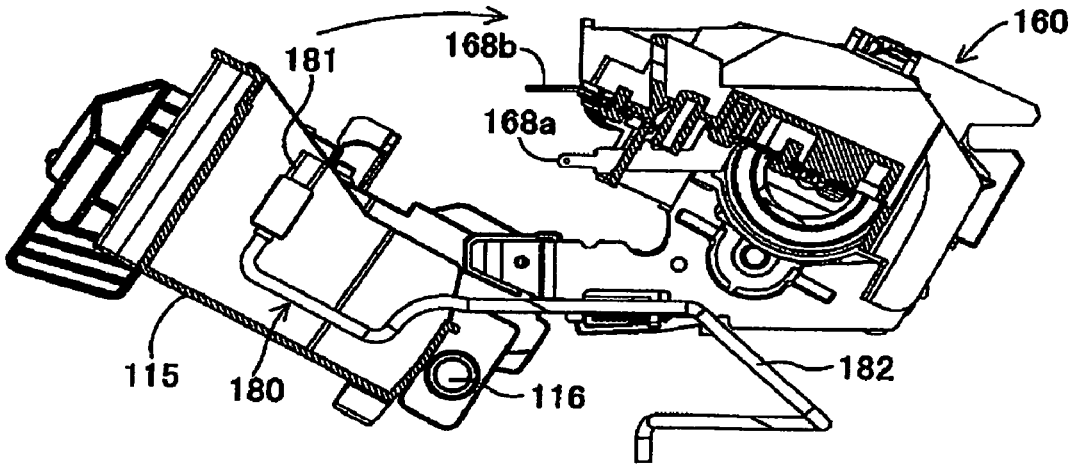
FIGS. 9A and 9B are side view showing a modified example of the connection section cover shown in FIG. 8.
Figure 9B:
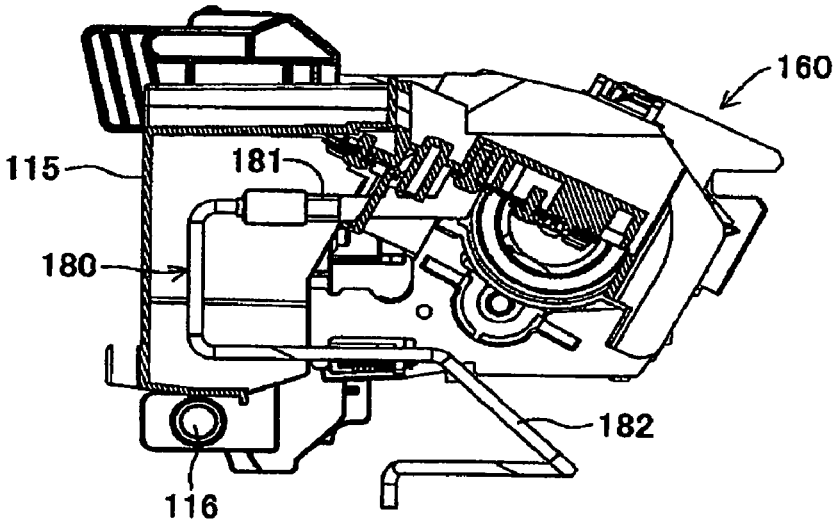

(iii) As shown in FIGS. 9A and 9B, the connection section cover 115 may be arranged so as to be rotatable (pivotable) about the pivot shaft 116.

Specifically, the connection section cover 115 in the modified example is configured to be opened or closed along the inserting direction (in the rightward direction in the figure) of the fixing unit 160. The pivot shaft 116 is arranged so as to project from the side frame 110*a*1 (see FIG. 6 or FIG. 8) toward the sheet widthwise direction. The connector 181 is fixed to the connection section cover 115, whereby it rotates (pivots) with the connection section cover 115.

According to this configuration, when the connection section cover 115 is opened, the electric power supply to the fixing unit 160 is cut off, as shown in FIG. 9A. On the other hand, closing the connection section cover 115 brings the state in which the electric power can be supplied to the fixing unit 160, as shown in FIG. 9B.

In this case, the connection section cover 115 may be opened or closed with the opening or closing operation of the rear cover 114. For example, the connection section cover 115 may be formed integral with the rear cover 114.

(iv) The components expressed in operational and functional manners in each component constituting the means for solving the problem of the invention include any structures that can realize the operation and function, in addition to the specific structure, disclosed in the aforesaid embodiment and modified examples.

What is claimed is:

1. An image forming apparatus that is configured to fix an image by a developer onto a sheet-like recording medium, thereby capable of forming an image onto the recording medium, comprising:

a fixing unit configured to fix the image by the developer attached to the recording medium onto the recording medium; and a main body section to which the fixing unit is mounted, wherein a fixing unit mounting section, to which the fixing unit is mounted by insertion of the fixing unit from a near side toward a far side of the fixing unit mounting section along a predetermined inserting direction, is formed to the main body section, an electric power supply section configured to supply electric power to the fixing unit is arranged at the near side of the fixing unit mounting section in the inserting direction of the fixing unit, and a connection section configured to establish electrical connection to the electric power supply section is formed at the near side of the fixing unit in the inserting direction of the fixing unit.

2. The image forming apparatus according to claim 1, wherein the connection section is collectively formed at one end portion of the fixing unit in a direction perpendicular to the inserting direction, and the electric power supply section is formed at a position facing the connection section.

3. The image forming apparatus according to claim 2, wherein a fixing unit insertion opening section into which the fixing unit is inserted for mounting the fixing unit to the fixing unit mounting section is formed at the main body section, the fixing unit mounting section is composed of a portion at a front side of the inserting direction in an inner space of the fixing unit insertion opening section, and the electric power supply section is arranged at a position proximate to the connection section.

4. The image forming apparatus according to claim 3, wherein the fixing unit insertion opening section is formed to be open toward a transporting direction of the recording medium, and the connection section is formed to be exposed toward the transporting direction from the fixing unit.

5. The image forming apparatus according to claim 4, wherein the fixing unit comprises:

a hollow cylindrical heat roller that is arranged along a widthwise direction of the recording medium that is perpendicular to the transporting direction and a thickness direction of the recording medium, and accommodates a heater that generates heat for heating the developer;

a facing roller that is arranged along the widthwise direction of the recording medium so as to face the heat roller, in order to send the recording medium in the transporting direction due to rotation with the recording medium nipped with the heat roller;

a fixing unit case that is configured to rotatably support both end portions of the heat roller in the widthwise direction and to cover the heat roller; and a facing roller support member that is supported at both end portions of the fixing unit case in the widthwise direction and rotatably supports both end portions of the facing roller in the widthwise direction, wherein the connection section is formed at the fixing unit case so as to supply electric power to the heater.

6. The image forming apparatus according to claim 5, wherein the fixing unit case and the facing roller support member are configured to expose the facing roller to the outside of the fixing unit.

7. The image forming apparatus according to claim 6, wherein a drive gear configured to transmit rotational drive force from the main body section is mounted to the end portion of the heat roller or the facing roller in the widthwise direction, and the connection section is formed at the end portion of the fixing unit case in the widthwise direction that is opposite to a side where the drive gear is arranged.

8. The image forming apparatus according to claim 7, further comprising a conductive member configured to electrically connect the heater with the connection section, wherein the conductive member is arranged in the fixing unit case along a surface facing the heat roller.

9. The image forming apparatus according to claim 8, wherein the conductive member is made of a metallic member that is not covered by a cylindrical insulating coating member.

10. The image forming apparatus according to claim 9, wherein the conductive member is composed of a plate-like member and a linear member connected to the plate-like member.

11. The image forming apparatus according to claim 10, further comprising a connection section cover configured to cover the connection section.

12. The image forming apparatus according to claim 11, wherein the connection section cover is arranged at the near side in the inserting direction.

13. The image forming apparatus according to claim 12, wherein the electric power supply section has a connector configured to be fitted to the connection section and a wiring section connected to the connector, and the main body section has a guide member configured to guide the wiring section.

14. The image forming apparatus according to claim 13, wherein the main body section has a pair of side frames arranged along the widthwise direction of the recording medium so as to support the fixing unit; and the guide member is arranged at the side frames.

15. The image forming apparatus according to claim 1, wherein the main body section has an open/close cover that is configured to be opened or closed along the inserting direction, and the electric power supply section is arranged at the open/close cover.

16. The image forming apparatus according to claim 2, wherein the fixing unit comprises:

a hollow cylindrical heat roller that is arranged along a widthwise direction of the recording medium that is perpendicular to a transporting direction and a thickness direction of the recording medium, and accommodates a heater that generates heat for heating the developer;

a facing roller that is arranged along the widthwise direction of the recording medium so as to face the heat roller, in order to send the recording medium in the transporting direction due to rotation with the recording medium nipped with the heat roller;

a fixing unit case that is configured to rotatably support both end portions of the heat roller in the widthwise direction and to cover the heat roller; and a facing roller support member that is supported at both end portions of the fixing unit case in the widthwise direction and rotatably supports both end portions of the facing roller in the widthwise direction, wherein the connection section is formed at the fixing unit case so as to supply electric power to the heater.

17. The image forming apparatus according to claim 16, wherein the fixing unit case and the facing roller support member are configured to expose the facing roller to the outside of the fixing unit.

18. The image forming apparatus according to claim 17, wherein a drive gear configured to transmit rotational drive force from the main body section is mounted to the end portion of the heat roller or the facing roller in the widthwise direction, and the connection section is formed at the end portion of the fixing unit case in the widthwise direction that is opposite to a side where the drive gear is arranged.

19. The image forming apparatus according to claim 18, further comprising a conductive member configured to electrically connect the heater with the connection section, wherein the conductive member is arranged in the fixing unit case along a surface facing the heat roller.

20. The image forming apparatus according to claim 19, wherein the conductive member is made of a metallic member that is not covered by a cylindrical insulating coating member.

21. The image forming apparatus according to claim 20, wherein the conductive member is composed of a plate-like member and a linear member connected to the plate-like member.

22. The image forming apparatus according to claim 21, further comprising a connection section cover configured to cover the connection section.

23. The image forming apparatus according to claim 22, wherein the connection section cover is arranged at the near side in the inserting direction.

24. The image forming apparatus according to claim 23, wherein the electric power supply section has a connector configured to be fitted to the connection section and a wiring section connected to the connector, and the main body section has a guide member configured to guide the wiring section.

25. The image forming apparatus according to claim 24, wherein the main body section has a pair of side frames arranged along the widthwise direction of the recording medium so as to support the fixing unit, and the guide member is arranged at the side frames.

26. The image forming apparatus according to claim 16, wherein the main body section has an open/close cover that is configured to be opened or closed along the inserting direction, and the electric power supply section is arranged at the open/close cover.

27. The image forming apparatus according to claim 2, further comprising a connection section cover configured to cover the connection section.

28. The image forming apparatus according to claim 27, wherein the connection section cover is arranged at the near side in the inserting direction.

29. The image forming apparatus according to claim 28, wherein the electric power supply section has a connector configured to be fitted to the connection section and a wiring section connected to the connector, and the main body section has a guide member configured to guide the wiring section.

30. The image forming apparatus according to claim 29, wherein the main body section has a pair of side frames arranged along the widthwise direction of the recording medium so as to support the fixing unit, and the guide member is arranged at the side frames.

31. The image forming apparatus according to claim 30, wherein the main body section has an open/close cover that is configured to be opened or closed along the inserting direction, and the electric power supply section is arranged at the open/close cover.

32. The image forming apparatus according to claim 2, wherein the electric power supply section has a connector configured to be fitted to the connection section and a wiring section connected to the connector, and the main body section has a guide member configured to guide the wiring section.

33. The image forming apparatus according to claim 32, wherein the main body section has a pair of side frames arranged along the widthwise direction of the recording medium so as to support the fixing unit, and the guide member is arranged at the side frames.

34. The image forming apparatus according to claim 33, wherein the main body section has an open/close cover that is configured to be opened or closed along the inserting direction, and the electric power supply section is arranged at the open/close cover.

35. A fixing device that is configured to be capable of fixing an image by a developer onto a sheet-like recording medium, and that is configured to be mounted to a main body section of an image forming apparatus by insertion thereof into the main body section from a near side toward a far side of the main body section along a predetermined inserting direction of the fixing device, comprising:

a hollow cylindrical heat roller that is arranged along a widthwise direction of the recording medium that is perpendicular to a transporting direction and a thickness direction of the recording medium, and accommodates a heater that generates heat for heating the developer;

a facing roller that is arranged along the widthwise direction of the recording medium so as to face the heat roller, in order to be able to send the recording medium in the transporting direction due to rotation with the recording medium nipped with the heat roller;

a fixing unit case that is configured to rotatably support both end portions of the heat roller in the widthwise direction and to cover the heat roller; and a facing roller support member that is supported at both end portions of the fixing unit case in the widthwise direction and rotatably supports both end portions of the facing roller in the widthwise direction, wherein a connection section that is configured to be electrically connected to an electric power supply section extending from the main body section configured to supply electric power to the heater is formed at the near side of the fixing unit case in the inserting direction of the fixing device.

36. The fixing device according to claim 35, further comprising a conductive member configured to electrically connect the heater with the connection section, wherein the conductive member is arranged in the fixing unit case along a surface facing the heat roller.

37. The fixing device according to claim 36, wherein the conductive member is made of a metallic member that is not covered by a cylindrical insulating coating member.

38. The fixing device according to claim 37, wherein the conductive member is composed of a plate-like member and a linear member connected to the plate-like member.

39. The fixing device according to claim 38, further comprising a connection section cover configured to cover the connection section.

40. The fixing device according to claim 39, wherein the connection section cover is arranged at the near side in the inserting direction.

41. The fixing device according to claim 40, wherein the connection section is collectively formed at one end portion of the fixing unit in the widthwise direction.

42. The fixing device according to claim 41, wherein the connection section is formed so as to be exposed toward the transporting direction.

43. The fixing device according to claim 42, wherein the fixing unit case and the facing roller support member are configured to expose the facing roller to the outside.

44. The fixing device according to claim 43, wherein a drive gear configured to transmit rotational drive force from the main body section is mounted to the end portion of the heat roller or the facing roller in the widthwise direction, and the connection section is formed at the end portion of the fixing unit case in the widthwise direction that is opposite to a side where the drive gear is arranged.

45. The fixing device according to claim 35, further comprising a connection section cover configured to cover the connection section.

46. The fixing device according to claim 45, wherein the connection section cover is arranged at the near side in the inserting direction.

47. The fixing device according to claim 46, wherein the connection section is collectively formed at one end portion of the fixing unit in the widthwise direction.

48. The fixing device according to claim 47, wherein the connection section is formed so as to be exposed toward the transporting direction.

49. The fixing device according to claim 48, wherein the fixing unit case and the facing roller support member are configured to expose the facing roller to the outside.

50. The fixing device according to claim 49, wherein a drive gear configured to transmit rotational drive force from the main body section is mounted to the end portion of the heat roller or the facing roller in the widthwise direction, and the connection section is formed at the end portion of the fixing unit case in the widthwise direction that is opposite to a side where the drive gear is arranged.

51. An image forming apparatus that is configured to fix an image by a developer onto a sheet-like recording medium, thereby capable of forming an image onto the recording medium, comprising:

a fixing unit configured to fix the image by the developer attached to the recording medium onto the recording medium; and a main body section to which the fixing unit is mounted, wherein a fixing unit mounting section, to which the fixing unit is mounted by insertion of the fixing unit from a near side toward a far side of the fixing unit mounting section along a predetermined inserting direction of the fixing unit, is formed to the main body section, a first electrical connection section configured to establish electrical connection to the fixing unit is arranged at the near side of the fixing unit mounting section in the inserting direction of the fixing unit, and a second connection section configured to establish electrical connection to the first electrical connection section is formed at the near side of the fixing unit in the inserting direction of the fixing unit.

52. The image forming apparatus according to claim 51, wherein the main body section has an open/close cover that is configured to be opened or closed along the inserting direction, and the first electrical connection section is arranged at the open/close cover.

* * * * *